US011388524B2

(12) United States Patent
Lutsky et al.

(10) Patent No.: US 11,388,524 B2
(45) **Date of Patent: *Jul. 12, 2022**

(54) DIFFERENTIAL ULTRASONIC TRANSDUCER ELEMENT FOR ULTRASOUND DEVICES

(71) Applicant: BFLY Operations, Inc., Guilford, CT (US)

(72) Inventors: Joseph Lutsky, Los Altos, CA (US); Nevada J. Sanchez, Guilford, CT (US); Kailiang Chen, Branford, CT (US); Keith G. Fife, Palo Alto, CA (US); Tyler S. Ralston, Clinton, CT (US)

(73) Assignee: BFLY OPERATIONS, INC., Guilford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/114,411

(22) Filed: Dec. 7, 2020

(65) Prior Publication Data

US 2021/0160621 A1 May 27, 2021

Related U.S. Application Data

(63) Continuation of application No. 16/016,359, filed on Jun. 22, 2018, now Pat. No. 10,972,842.

(Continued)

(51) Int. Cl.

| | |
|---|---|
| ***H04R 17/00*** | (2006.01) |
| ***B06B 1/02*** | (2006.01) |
| ***B06B 1/06*** | (2006.01) |

(52) U.S. Cl.

CPC ..... *H04R 17/00* (2013.01); *B06B 1/0215* (2013.01); *B06B 1/0292* (2013.01); *B06B 1/0622* (2013.01)

(58) Field of Classification Search

CPC ..... H04R 17/00; B06B 1/0215; B06B 1/0292; B06B 1/0622

See application file for complete search history.

(56) References Cited

U.S. PATENT DOCUMENTS 6,320,239 B1 11/2001 Eccard et al.
8,852,103 B2 10/2014 Rothberg et al.

(Continued)

FOREIGN PATENT DOCUMENTS

AU 2018290333 A1 * 12/2019 ..... H04R 17/00
AU 2018290333 A1 12/2019

(Continued)

OTHER PUBLICATIONS

International Search Report and Written Opinion dated Sep. 19, 2018 in connection with International Application No. PCT/US2018/038999.

(Continued)

*Primary Examiner* — Daniel Pihulic
(74) *Attorney, Agent, or Firm* — Osha Bergman Watanabe & Burton LLP

(57) ABSTRACT

Aspects of the technology described herein relate to ultrasound circuits that employ a differential ultrasonic transducer element, such as a differential micromachined ultrasonic transducer (MUT) element. The differential ultrasonic transducer element may be coupled to an integrated circuit that is configured to operate the differential ultrasonic transducer element in one or more modes of operation, such as a differential receive mode, a differential transmit mode, a single-ended receive mode, and a single-ended transmit mode.

20 Claims, 24 Drawing Sheets

Related U.S. Application Data

(60) Provisional application No. 62/524,285, filed on Jun. 23, 2017.

(56) References Cited

U.S. PATENT DOCUMENTS

| | | | | |
|---|---|---|---|---|
| 9,067,779 | B1 | 6/2015 | Rothberg et al. | |
| 9,229,097 | B2 | 1/2016 | Rothberg et al. | |
| 9,242,275 | B2 | 1/2016 | Rothberg et al. | |
| 9,505,030 | B2 | 11/2016 | Rothberg et al. | |
| 9,521,991 | B2 | 12/2016 | Rothberg et al. | |
| 9,592,030 | B2 | 3/2017 | Rothberg et al. | |
| 9,592,032 | B2 | 3/2017 | Rothberg et al. | |
| 10,972,842 | B2 * | 4/2021 | Lutsky | B06B 1/0215 |
| 2004/0160144 | A1 | 8/2004 | Daft et al. | |
| 2007/0287918 | A1 | 12/2007 | Huang | |
| 2009/0182233 | A1 | 7/2009 | Wodnicki | |
| 2011/0055447 | A1 | 3/2011 | Costa | |
| 2015/0087977 | A1 | 3/2015 | Rothberg et al. | |
| 2016/0107194 | A1 | 4/2016 | Panchawagh et al. | |
| 2017/0202541 | A1 | 7/2017 | Ralston | |
| 2017/0307741 | A1 | 10/2017 | Ralston et al. | |
| 2017/0360397 | A1 | 12/2017 | Rothberg et al. | |
| 2018/0376253 | A1 * | 12/2018 | Lutsky | H04R 17/00 |
| 2019/0142387 | A1 * | 5/2019 | Chen | A61B 8/54 367/135 |
| 2019/0261954 | A1 * | 8/2019 | Chen | A61B 8/54 |
| 2019/0261955 | A1 * | 8/2019 | Chen | A61B 8/4483 |
| 2021/0160621 | A1 * | 5/2021 | Lutsky | H04R 17/00 |

FOREIGN PATENT DOCUMENTS

| | | | | |
|---|---|---|---|---|
| AU | 2018369882 | A1 * | 5/2020 | A61B 8/54 |
| CA | 3064279 | A1 * | 12/2018 | H04R 17/00 |
| CA | 3064279 | A1 | 12/2018 | |
| CA | 3081760 | A1 * | 5/2019 | A61B 8/54 |
| CN | 111479514 | A * | 7/2020 | H04B 11/00 |
| EP | 3709894 | A1 * | 9/2020 | A61B 8/5207 |
| EP | 3641954 | A4 * | 3/2021 | B06B 1/0215 |
| JP | 2014236841 | A | 12/2014 | |
| KR | 20200088380 | A * | 7/2020 | A61B 8/4483 |
| WO | WO 2016/054448 | A1 | 4/2016 | |
| WO | WO 2018/237267 | A1 | 12/2018 | |
| WO | WO-2018237267 | A1 * | 12/2018 | B06B 1/0215 |
| WO | WO-2019099638 | A1 * | 5/2019 | G01S 7/52017 |

OTHER PUBLICATIONS

International Preliminary Report on Patentability dated Jan. 2, 2020 in connection with International Application No. PCT/US2018/038999.

Daft et al., A Matrix Transducer Design with Improved Image Quality and Acquisition Rate. 2007 IEEE Ultrasonics Symposium. Oct. 1, 2007;411-5.

Daft et al., Microfabricated Ultrasonic Transducers Monolithically Integrated with High Voltage Electronics. 2004 IEEE Ultrasonics Symposium. Aug. 23, 2004;493-6.

Gurun et al., Front-end CMOS Electronics for Monolithic Integration with CMUT Arrays: Circuit Design and Initial Experimental Results. 2008 IEEE International Ultrasonics Symposium Proceedings. 2008;390-3.

Kupnik et al., Wafer-Bonded CMUT Meets CMOS. 2010 CMOS Emerging Technology Workshop. Whistler, Canada. May 21, 2010;1-22.

Extended European Search Report dated Feb. 16, 2021 in connection with European Application No. 18819879.0.

[No Author Listed], LMP8350 Ultra-Low Distortion Fully-Differential Precision ADC Driver With Selectable Power Modes. Texas Instruments. Feb. 2011. Revised Oct. 2015. 38 pages.

U.S. Appl. No. 16/016,359, filed Jun. 22, 2018, Lutsky et al.

PCT/US2018/038999, Sep. 19, 2018, International Search Report and Written Opinion.

PCT/US2018/038999, Jan. 2, 2020, International Preliminary Report on Patentability.

* cited by examiner

DIFFERENTIAL ULTRASONIC TRANSDUCER ELEMENT FOR ULTRASOUND DEVICES

RELATED APPLICATIONS

This application is a continuation claiming the benefit under 35 U.S.C. § 120 of U.S. application Ser. No. 16/016,359, titled "DIFFERENTIAL ULTRASONIC TRANSDUCER ELEMENT FOR ULTRASOUND DEVICES" filed on Jun. 22, 2018, which is hereby incorporated herein by reference in its entirety.

U.S. application Ser. No. 16/016,359 claims the benefit under 35 U.S.C. § 119(e) of U.S. Provisional Application Ser. No. 62/524,285, titled "DIFFERENTIAL ULTRASONIC TRANSDUCER ELEMENT FOR ULTRASOUND DEVICES" filed on Jun. 23, 2017, which is hereby incorporated herein by reference in its entirety.

FIELD

Generally, the aspects of the technology described herein relate to ultrasonic transducers. Some aspects relate to differential ultrasonic transducer elements.

BACKGROUND

Capacitive micromachined ultrasonic transducers (CMUTs) are known devices that include a membrane above a micromachined cavity. The membrane may be used to transduce an acoustic signal into an electric signal, or vice versa. Thus, CMUTs can operate as ultrasonic transducers.

SUMMARY

According to at least one aspect, an ultrasound circuit is provided. The ultrasound circuit comprises a differential micromachined ultrasonic transducer (MUT) element and an integrated circuit coupled to the differential MUT element and configured to operate the differential MUT element in a differential receive mode and/or a differential transmit mode.

In some embodiments, the integrated circuit is configured to operate the differential MUT element in the differential receive mode and the differential transmit mode. In some embodiments, the differential MUT element is integrated into an ultrasonic transducer array and wherein the integrated circuit and the ultrasonic transducer array are formed on a single semiconductor die. In some embodiments, the differential MUT element is a differential capacitive micromachined ultrasonic transducer (CMUT) element or a differential piezoelectric micromachined ultrasonic transducer (PMUT) element.

According to at least one aspect, an ultrasound circuit is provided. The ultrasound circuit comprises a differential micromachined ultrasonic transducer (MUT) element comprising a first MUT that is configured to be biased with a first bias voltage and a second MUT that is configured to be biased with a second bias voltage and an integrated circuit coupled to the differential MUT element and configured to operate the differential MUT element.

In some embodiments, the first bias voltage is different from the second bias voltage. In some embodiments, the integrated circuit comprises transmit circuit that is configured to operate the differential MUT element to transmit acoustic signals. In some embodiments, the transmit circuit comprises a differential pulser that is configured to generate a first pulse signal to drive the first MUT and a second pulse signal that has an opposite polarity of the first pulse signal that is configured to drive the second MUT.

In some embodiments, the integrated circuit comprises receive circuit that is configured to operate the differential MUT element to receive acoustic signals. In some embodiments, the receive circuit comprises a differential transimpedance amplifier (TIA) having a first input coupled to the first MUT, a second input coupled to the second CMUT, a first output coupled to the first input by a first impedance, and a second output coupled to the second input by a second impedance. In some embodiments, the receive circuit comprises a differential analog-to-digital converter having a first input coupled to the first output of the differential TIA and a second input coupled to the second output of the differential TIA. In some embodiments, the receive circuit comprises a first switch coupled between the first input of the differential TIA and the first MUT and a second switch coupled between the second input of the differential TIA and the second MUT.

In some embodiments, the integrated circuit is configured to operate the differential MUT element in a plurality of modes comprising at least one mode selected from the group consisting of: a single-ended receive mode, a differential receive mode, a single-ended transmit mode, and a differential transmit mode. In some embodiments, the ultrasound circuit further comprises a third MUT that is biased with the first bias voltage and a fourth MUT that is biased with the second bias voltage. In some embodiments, the first MUT and the third MUT are arranged in a first row of a 2 by 2 array and wherein the second MUT and the fourth MUT are arranged in a second row of the 2 by 2 array. In some embodiments, the first MUT and the second MUT are arranged in a first row of a 2 by 2 array and wherein the third MUT and the fourth MUT are arranged in a second row of the 2 by 2 array.

According to at least one aspect, a method of operating an ultrasound circuit comprising a differential micromachined transducer (MUT) element is provided. The method comprises biasing the differential MUT element at least in part by biasing a first MUT of the differential MUT element with a first bias voltage and biasing a second MUT of the differential MUT element with a second bias voltage and operating the differential MUT element after biasing the differential MUT element.

In some embodiments, operating the differential MUT element comprises operating the differential MUT element to transmit acoustic signals at least in part by driving the first MUT with a first pulse signal and driving the second MUT with a second pulse signal that has an opposite polarity of the first pulse signal. In some embodiments, operating the differential MUT element comprises operating the differential MUT element to receive acoustic signals at least in part by controlling a state of at least one switch to couple the first MUT to a first input of a differential transimpedance amplifier (TIA) and couple the second MUT to a second input of the differential TIA. In some embodiments, operating the differential MUT to receive acoustic signals comprises digitizing an output of an analog processing circuit that comprises the differential TIA using a differential analog-to-digital converter.

BRIEF DESCRIPTION OF THE DRAWINGS

Various aspects and embodiments will be described with reference to the following exemplary and non-limiting figures. It should be appreciated that the figures are not necessarily drawn to scale. Items appearing in multiple figures are indicated by the same reference number in all the figures in which they appear.

DETAILED DESCRIPTION

Figure 1A:
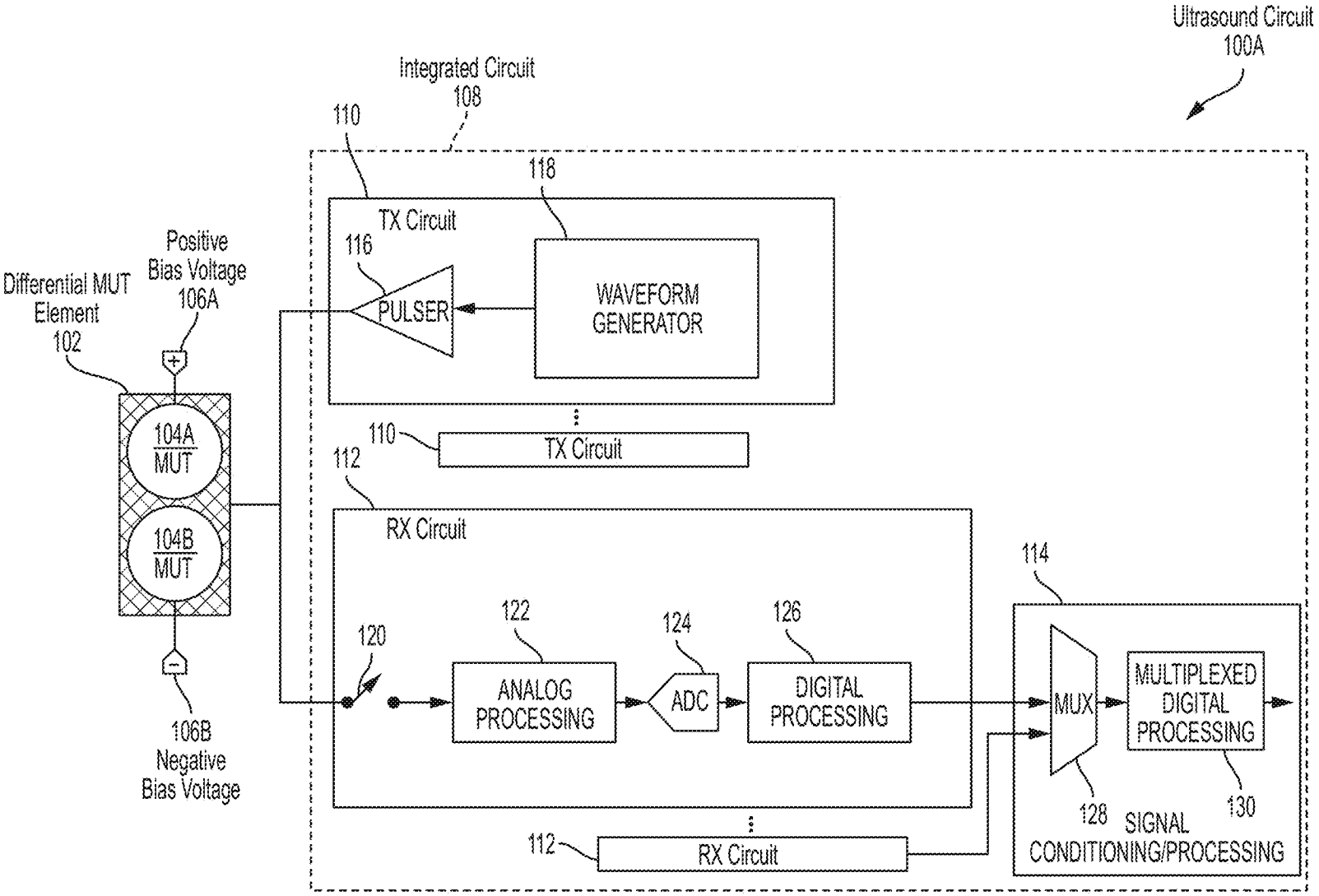
FIGS. 1A and 1B show exemplary ultrasound circuits including a differential micromachined ultrasound transducer (MUT) element, in accordance with some embodiments of the technology described herein.

Some ultrasound devices comprise a plurality of capacitive micromachined ultrasonic transducers (CMUTs) configured to transmit and/or receive acoustic signals. These CMUTs are typically controlled using only single-ended signaling techniques. For example, the plurality of CMUTs may be driven in unison by the same pulse signal during transmission of an acoustic signal. Similarly, the electrical signals generated by each of the CMUTs during receipt of an acoustic signal may be separately received and processed by a respective receiver in a set of receivers. The inventors have appreciated that, as a result of their single-ended nature, such ultrasound devices are susceptible to numerous noise sources that may undesirably degrade electric signals from (or going to) the CMUTs. For example, the electric signals from the CMUTs may be corrupted by noise from supply voltage lines, bias voltage lines, and/or ground lines. The signal degradation caused by these various sources may reduce the quality of ultrasound images formed using such ultrasound devices.

Accordingly, some embodiments of the present application provide an ultrasound circuit that utilizes differential micromachined ultrasonic transducer (MUT) technology. In particular, in accordance with an aspect of the present application, a differential MUT element is described herein that may be employed in combination with differential signaling techniques (e.g., pseudo differential signaling techniques and/or fully differential signaling techniques). The differential MUT elements described herein may be implemented using any of a variety of MUTs such as piezoelectric micromachined ultrasonic transducers (PMUTs) or CMUTs. Such a differential configuration and operating scheme may reduce or otherwise eliminate the degradation caused by various noise sources and decrease signal processing distortion. Thus, ultrasound devices including such differential MUT technology may be more robust and may produce higher fidelity images.

The differential MUT element may comprise multiple MUTs, such as PMUTs and/or CMUTs, that are biased with bias voltages. These bias voltages may be the same or different for MUTs within the differential MUT element. For example, the differential MUT element may comprise a first MUT that is biased with a positive voltage and a second MUT that is adjacent the first MUT and biased with a negative voltage, such that the electric signals generated by the first MUT during receipt of an acoustic signal may have an opposite polarity of those generated by the second MUT. Such biasing of the differential MUT element may facilitate the use of differential signaling techniques in some implementations. For example, a receive circuit coupled to the differential MUT element may process electric signals from the differential MUT element by identifying a difference between the electric signals from the first and second MUTs in the differential MUT element. As a result, noise that similarly impacts the electric signals from both MUTs (such as noise from nearby voltage supply lines) may be canceled out because such noise does not impact the difference between the two electric signals. In another example, a differential pulser driving a differential MUT element may nearly eliminate the current injected into the ground reference node, which reduces undesirable ground bounce that may interfere with circuit operation. Thus, the differential pulser can apply much larger transmit waveforms to the differential MUT before deleterious effects occur allowing for larger transmit pressures that enlarge the receive echoes. As a result, the quality of ultrasound data and/or images produced using such a differential MUT element may be improved.

The aspects and embodiments described above, as well as additional aspects and embodiments, are described further below. These aspects and/or embodiments may be used individually, all together, or in any combination of two or more, as the application is not limited in this respect.

FIG. 1A shows an example ultrasound circuit 100A comprising a differential MUT element 102. The differential MUT element 102 comprises a MUT 104A that is biased with a positive bias voltage 106A and MUT 104B that is biased with a negative bias voltage 106B. The differential MUT element 102 is operated by (and coupled to) an integrated circuit 108. The integrated circuit 108 comprises transmit (TX) circuits 110, receive (RX) circuits 112, and a signal conditioning/processing circuit 114.

The differential MUT element 102 comprises MUTs 104A and 104B that may each include two electrodes (e.g., plates). In a CMUT, the two electrodes may be separated by a cavity. A first electrode (e.g., a top electrode) in the CMUT may be allowed to move with respect to the second electrode (e.g., a bottom electrode), and the electrical properties of the CMUT may change as the top electrode moves with respect to the bottom electrode. The top electrode may be implemented as, for example, a metalized membrane and the bottom electrode may be implemented as, for example, a doped silicon substrate. A CMUT may further comprise an insulating layer between the top and bottom electrodes to prevent the CMUT from electrically shorting in the event the top electrode comes in contact with the bottom electrode, as can happen during collapse mode operation, as an example. In a PMUT, the two electrodes may be separated by a piezoelectric material that generates an electric signal when deformed and, conversely, deforms when an electric signal is applied.

The MUTs 104A and 104B may be biased by, for example, coupling one of the two electrodes (e.g., the top electrode) to a bias voltage (e.g., positive bias voltage 106A and/or negative bias voltage 106B). In some embodiments, the MUTs 104A and 104B are biased with different voltages. For example, the MUT 104A may be biased with a first voltage (e.g., the positive bias voltage 106A) and the MUT 104B may be biased with a second voltage that has an opposite polarity of the first voltage (e.g., the negative bias voltage 106B). In examples where additional MUTs are employed in the differential MUT element 102, a first portion (e.g., a first half) of the MUTs may be biased with the first voltage (e.g., the positive bias voltage 106A) and a second portion of the MUTs (e.g., a second half) may be biased with the second voltage (e.g., the negative bias voltage 106B).

The transmit circuit 110 may be configured to operate the differential MUT element 102 to generate acoustic signals. For example, the transmit circuit 110 may be configured to apply an alternating current (AC) signal (e.g., a pulse signal) to one of the electrodes (e.g., the bottom electrode) of one or more MUTs in the differential MUT element 102 (e.g., MUTs 104A and/or 104B) to generate an acoustic signal. In some embodiments, the transmit circuit 110 employs a pulser 116 to generate the pulse signal. The pulser 116 may be, for example, configured to generate unipolar pulses and/or bipolar pulses to drive the MUTs 104A and/or 104B. In these embodiments, the pulser 116 may receive a waveform from a waveform generator 118 and generate the pulse signal based on this received waveform. It should be appreciated that the pulses provided by the pulser 116 to the MUTs 104A and 104B need not be completely in-phase (e.g., have a 0 degree phase difference) or completely out of phase (e.g., have a 180 degree phase difference). For example, the pulses provided to the MUT 104A may be delayed by a quarter pulse period (e.g., have a 90 degree phase difference) relative to the pulses provided to the MUT 104B.

The receive circuit 112 may be configured to receive and process electronic signals generated by the differential MUT element 102 when acoustic signals impinge upon the element. In some embodiments, the receive circuit 112 comprises a switch 120 (sometimes referred to as a "receive switch") that selectively couples one or more components of the receive circuit 112 to one or more MUTs in the differential MUT element 102 (e.g., the MUTs 104A and/or 104B) based on an operating mode of the ultrasound circuit 100A (e.g., transmit mode or receive mode). For example, the switch 120 may be open when the ultrasound circuit 100A is operating in a transmit mode and closed when the ultrasound circuit 100A is operating in a receive mode. The receive circuit 112 may comprise one or more components to detect and/or process electronic signals generated by the differential MUT element 102. For example, the receive circuit 112 may comprise analog processing circuit 122 that processes a signal (e.g., a voltage signal or a current signal) indicative of a displacement of a top electrode relative to the bottom electrode. The analog processing circuit 122 may comprise any of a variety of components such as: a transimpedance amplifier (TIA), a variable-gain amplifier, a delay line, a time-gain-compensation amplifiers, a buffer, and/or a mixer. An output signal of the analog processing circuit 122 may be digitized by an analog-to-digital converter (ADC) 124. The ADC 124 may comprise a differential ADC and/or a single-ended ADC. Example ADCs include 8-bit, 10-bit, or 12-bit, 20 Msps, 25 Msps, 40 Msps, 50 Msps, or 80 Msps ADCs. Additional example ADCs include oversampled ADCs such as continuous-time or discrete-time, and/or low-pass or band-pass oversampled ADCs. The digital signal from the ADC 124 may be processed (e.g., filtered or otherwise manipulated) by a digital processing circuit 126. The digital processing circuit 126 may comprise memory such as dynamic random-access memory (DRAM) and/or static random-access memory (SRAM). The memory may store, for example, information regarding a received ultrasound signal for processing (e.g., by a digital signal processor).

In some embodiments, the digital processing circuit 126 may filter the received ultrasound data from the ADC 124 (e.g., to reduce the data rate) and store the ultrasound data in memory. In turn, the ultrasound data stored in memory may be offloaded from the ultrasound circuit 100A to another device. It should be appreciated that the rate at which the ultrasound data is captured may be different from the rate at which ultrasound data stored in memory is offloaded from the ultrasound circuit 100A. For example, the rate at which the ultrasound data is captured may be faster than the rate at which the ultrasound data is transmitted to an external device.

The integrated circuit 108 may comprise a plurality of transmit circuits 110 and/or receive circuits 112 as shown in FIG. 1A. For example, the differential MUT element 102 may be part of a transducer array that comprises a plurality of differential MUT elements 102. In this non-limiting example, each of the differential MUT elements 102 may be coupled to a separate transmit circuit 110 and/or a separate receive circuit 112 in the integrated circuit 108. However, other configurations are possible, such as two or more differential MUT elements 102 sharing a transmit circuit 110 and/or a receive circuit 112. In some embodiments, all differential MUT elements 102 are coupled to share the same transmit circuit 110 and/or receive circuit 112.

In embodiments where the ultrasound circuit 100A comprises multiple receive circuits 112, the outputs of all of the receive circuits 112 on the integrated circuit 108 may be fed to a multiplexer (MUX) 128 in the signal conditioning/processing circuit 114. The MUX 128 multiplexes the digital data from each of the receive circuits 112, and the output of the MUX 128 is fed to a multiplexed digital processing circuit 130 in the signal conditioning/processing circuit 114, for final processing before the data is output from the integrated circuit 108 using, for example, one or more high-speed serial output ports and/or one or more lower speed, parallel output ports.

It should be appreciated that various alterations may be made to the integrated circuit 108 without departing from the scope of the present disclosure. In some embodiments, one or more components of the integrated circuit 108 may be removed or added. For example, the MUX 128 may be removed in embodiments where parallel signal processing is performed and/or the switches 120 may be removed in embodiments where the MUTs 104A and/or 104B are hard-wired to the TX circuit 110 and/or the RX circuit 120. Additionally (or alternatively), the switch 120 in the RX circuits 112 may be replaced with a switch matrix 121 in some embodiments. In these embodiments, the switch matrix 121 may selectively couple MUTs 104A and/or 104B within the differential MUT element 102 to particular transmit circuits 110, receive circuits 112, particular components within the transmit circuits 110, and/or particular components with the receive circuits 112. Thereby, the connections between the bottom electrodes of the MUTs 104A and 104B may be dynamically connected to components within the integrated circuit 108. Such a feature may be employed to generate and/or receive acoustic signals using a selected portion of the MUTs 104A and/or 104B in a transducer array. The selected portion of the MUTs 104A and/or 104B may be selected consistent with, for example, a coding scheme such as a Hadamard coding scheme.

Figure 1B:
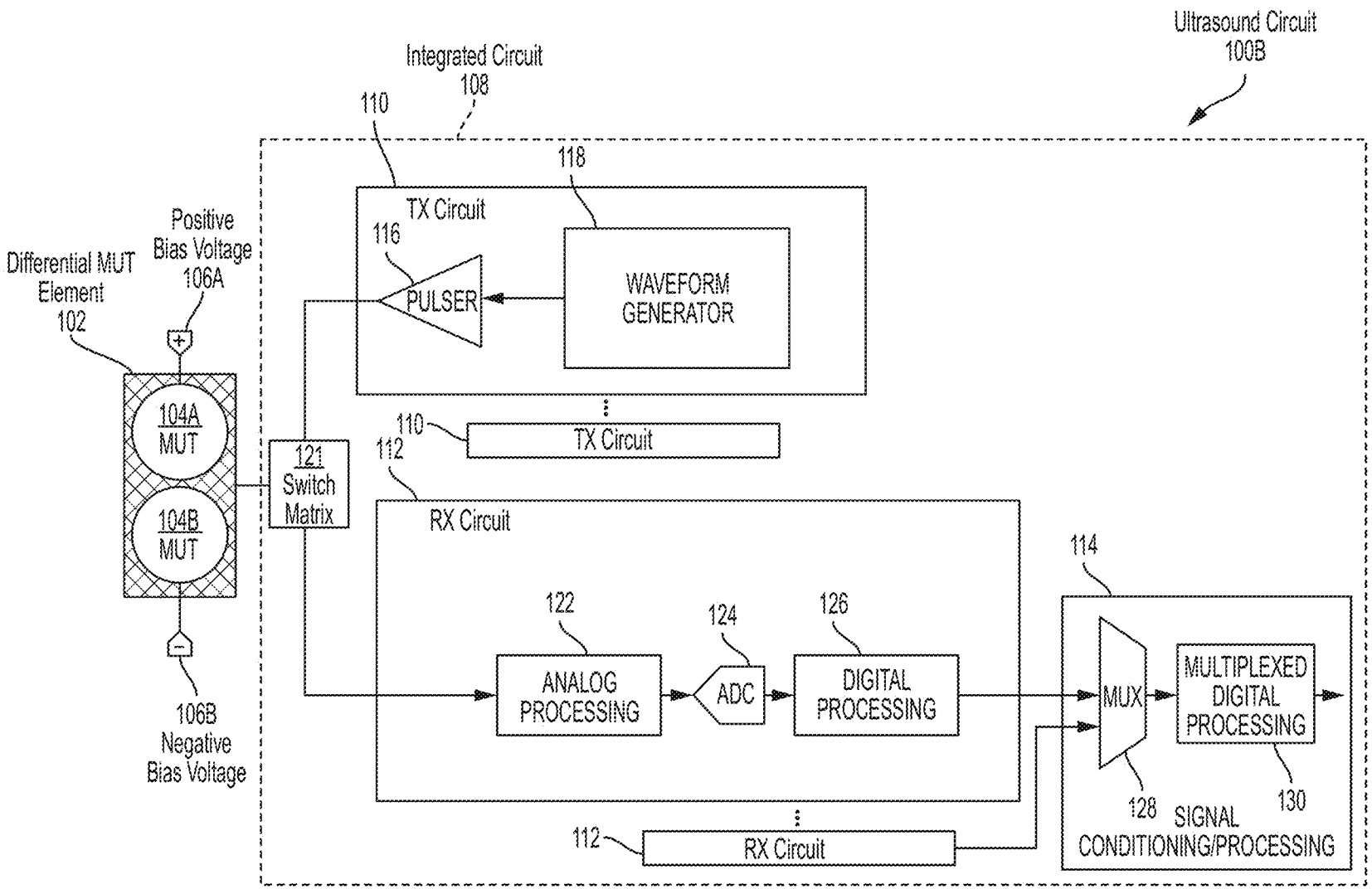
Figure 2B:
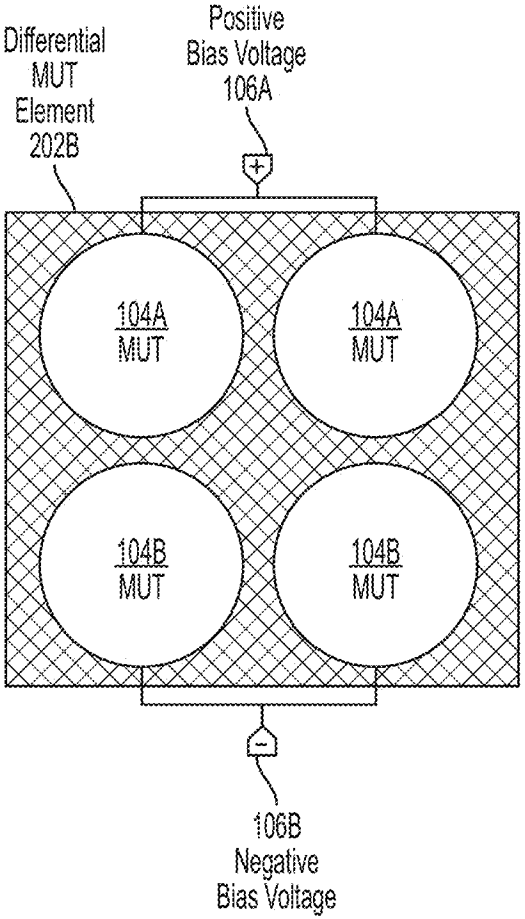
FIGS. 2A and 2B show exemplary differential MUT elements, in accordance with some embodiments of the technology described herein.
Figure 2A:
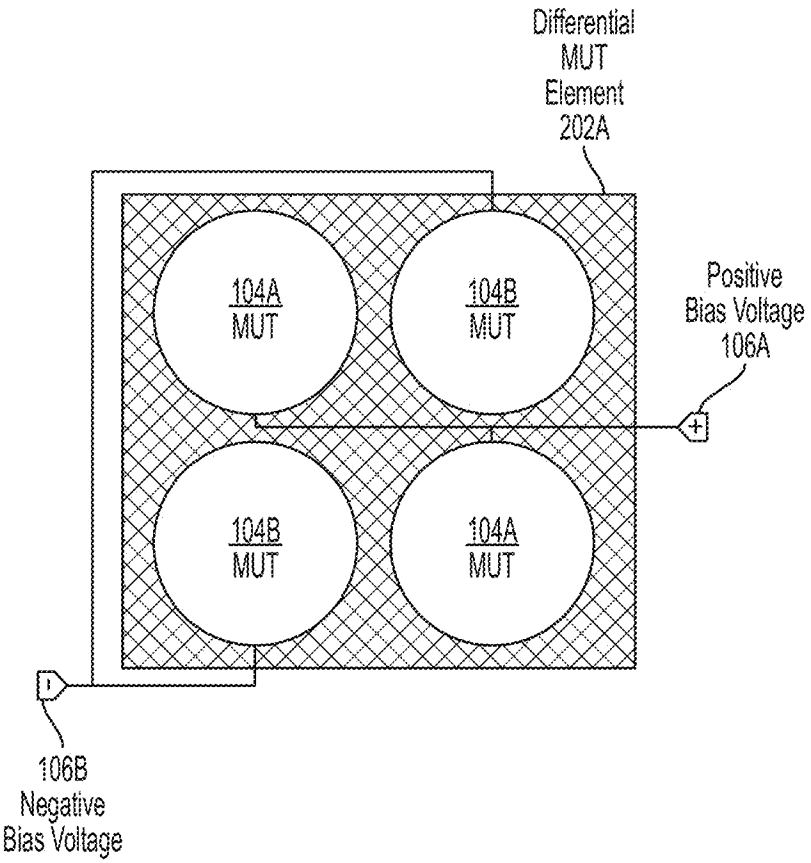

In some embodiments, the MUTs (e.g., MUTs 104A and 104B) in the differential MUT element 102 may be biased such that one or more MUTs, and in some situations each MUT, is adjacent at least one other MUT that is biased using a voltage with an opposite polarity. As shown in FIGs. 1A and 1B for example, the differential MUT element 102 may comprise MUT 104A that is biased with the positive bias voltage 106A and CMUT 104B that is adjacent MUT 104A and is biased with the negative bias voltage 106B. In other examples, the differential MUT element 102 may comprise four MUTs arranged in a 2 by 2 array (e.g., an array with two rows and two columns). FIGS. 2A and 2B illustrate examples of such differential MUT elements.

As shown in FIG. 2A, the differential MUT element 202A comprises four MUTs arranged in a 2 by 2 array. The MUTs 104A in the top left and bottom right corners are biased with the positive bias voltage 106A and the MUTs 104B in the top right and bottom left corners are biased with the negative bias voltage 106B. Thus, in this non-limiting example, each of the MUTs is adjacent at least two other MUTs that are biased using a voltage with an opposite polarity. In some embodiments, one or more MUTs of a differential MUT element are adjacent at least two other MUTs biased using a voltage with an opposite polarity. The configuration shown in FIG. 2A may be a common-centroid configuration where the centroid of the MUTs 104A is the same as the centroid of the MUTs 104B. Such a common centroid configuration may advantageously reject noise caused by, for example, a linear gradient in one or more parameters of the MUTs 104A and 104B.

As shown in FIG. 2B, the differential MUT element 202B comprises four MUTs arranged in a 2 by 2 array. The MUTs 104A in the top row are biased with the positive bias voltage 106A and the MUTs 104B in the bottom row are biased with the negative bias voltage 106B. Thus, in this non-limiting example, each of the MUTs is adjacent at least one other MUT that is biased using a voltage with an opposite polarity, although other configurations are possible. For example, one or more MUTs of a differential MUT element may be adjacent at least one other MUT biased using a voltage with an opposite polarity.

It should be appreciated that the depictions of differential MUT elements 102, 202A and 202B in FIGS. 1, 2A and 2B, respectively, with two or four MUTs with a circular shape is only for illustration. The differential MUT elements 102, 202A, and/or 202B may include additional (or fewer) MUTs. For example, the differential MUT elements 102, 202A, and/or 202B may include 3, 5, 6, 7, 8, or 9 MUTs. In some embodiments, the differential MUT elements 102, 202A, and/or 202B may have an even number of MUTs (e.g., 2, 4, 6, 8, 10, or 12 MUTs). Further, one or more of the MUTs in the differential MUT elements 102, 202A, and 202B may have a non-circular shape such as: a hexagonal shape or an octagonal shape.

Figure 3:
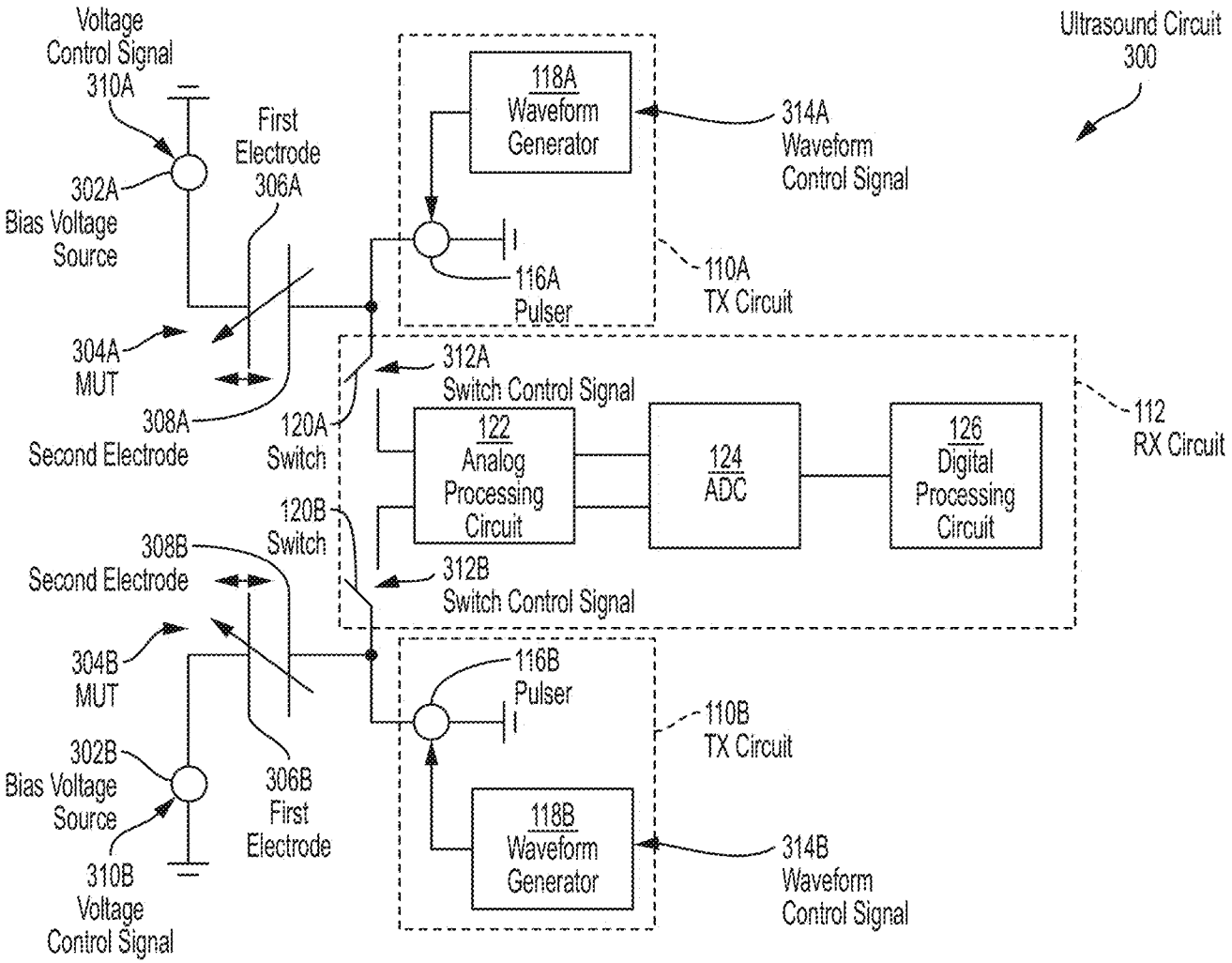
FIG. 3 shows an exemplary ultrasound circuit including a differential MUT element, in accordance with some embodiments of the technology described herein.

FIG. 3 shows an exemplary ultrasound circuit 300 comprising a differential MUT element formed by MUTs 304A and 304B coupled to bias voltages sources 302A and 302B, respectively. The ultrasound circuit 300 further comprises transmit circuits 110A and 110B and receive circuit 112 coupled to the MUTs 304A and 304B. Each of the MUTs 304A and 304B comprises a first electrode 306A and 306B, respectively, and a second electrode 308A and 308B, respectively. In embodiments where the MUTs 304A and 304B are CMUTs, the first electrode 306A and 306B, respectively, may be allowed to move with respect to a second electrode 308A and 308B, respectively. The movement of the first electrodes 306A and 306B relative to the second electrodes 308A and 308B, respectively, may be analyzed by the receive circuit 112 to process received acoustic signals. The transmit circuits 110A and 110B may use pulse signals to cause the first electrodes 306A and 306B to move relative to the second electrodes 308A and 308B, respectively, to generate acoustic signals. In embodiments where the MUTs 304A and 304B are PMUTs, the potential across the first electrodes 306A and 306B and the second electrodes, 308A and 308B, respectively, may be measured by the receive circuit 112 to identify a deformation of a piezoelectric between the electrodes and, thereby, analyze received acoustic signals. Conversely, the transmit circuits 110A and 110B may use pulse signals to cause the piezoelectric material between the electrodes to deform and, thereby, generate acoustic signals.

The first electrodes 306A and 306B may be coupled to bias voltage sources 302A and 302B, respectively. The bias voltage sources 302A and 302B may generate bias voltages for the MUTs 304A and 304B, respectively. The bias voltage sources 302A and/or 302B may be located on the same chip as the MUTs 304A and 304B or another chip that is external to the MUTs 304A and 304B. The bias voltage sources 302A and 302B may be fixed voltage sources or variable voltage sources. For example, the bias voltage sources 302A and 302B may be variable voltage sources that receive voltage control signals 310A and 310B, respectively, and generate a voltage based on the respective control signal. Thereby, the bias voltage generated by the viable voltage sources may be adjusted differently for different modes of operation (e.g., a transmit mode of operation and a receive mode of operation). In some embodiments, the bias voltages generated by the bias voltage source 302A and 302B may have an opposite polarity. For example, the bias voltage source 302A may generate a positive voltage and the bias voltage source 302B may generate a negative voltage.

The second electrodes 308A and 308B may be coupled to transmit circuits 110A and 110B, respectively. The transmit circuits 110A and 110B may be configured to drive the MUTs 304A and 304B, respectively, in unison using one or more pulse signals. For example, the first electrode 306A may be attracted to the second electrode 308A when the first electrode 306B is also attracted to the second electrode 308B. The waveforms generated by the waveform generators 118A and 118B (and thereby the pulse signals from the pulsers 116A and 116B) may be adjusted using waveform control signals 314A and 314B, respectively, based on the bias voltages applied to the MUTs 304A and 304B. For example, the MUTs 304A and 304B may be biased with voltages that have an opposite polarity. In this example, the pulse signal generated by the pulser 116A may have an opposite polarity of the pulse signal generated by the pulse 116B such that the MUTs 304A and 304B are driven in unison. In another example, the bias voltage applied to both MUTs 304A and 304B may be the same. In this example, the pulse signal generated by the pulses 116A and 116B may be the same.

In some embodiments, the connections of the electrodes 306A and 308A of the MUT 304A may be swapped relative to the connections of the electrodes 306B and 308B of the MUT 304B. For example, the second electrode 308B may be coupled to the bias voltage source 302B while the second electrode 308A is coupled to the transmit circuit 110A and the receive circuit 112. Further, the first electrode 306B may be coupled to the transmit circuit 110B and the receive circuit 112 while the first electrode 306A may be coupled to the bias voltage source 302A. Such a configuration of the ultrasound circuit 300 may be employed in, for example, embodiments where the MUTs 304A and 304B in a differential MUT element are implemented as PMUTs.

It should be appreciated that the transmit circuits 110A and 110B need not be two separate circuits with two separate pulsers 116A and 116B as shown in FIG. 3. For example, the transmit circuits 110A and 110B may be implemented in a single circuit with a single pulser (in place of the pulsers 116A and 116B) and a single waveform generator (in place of waveform generators 118A and 118B). The single pulser may be constructed using, for example, one or more differential or single-ended pulsers. The single pulser may be, for example, configured to generate two sets of pulse signals. For example, the single pulser may generate a first pulse signal for the MUT 304A and a second pulse signal for the MUT 304B. The first pulse signal may be phase shifted relative to the second pulse signal. For example, the first pulse signal may be phase shifted by 180 degrees (e.g., have an opposite polarity) relative to the second pulse signal. In another example, the first pulse signal may be phase shifted by less than 180 degrees relative to the second pulse signal (e.g., phase shifted by 120 degrees, 90 degrees, or 30 degrees).

The second electrodes 308A and 308B may also be coupled (e.g., switchably coupled) to the receive circuit 112. The receive circuit 112 may comprise switches 120A and 120B that selectively couple one or more components of the receive circuit 112 (such as the analog processing circuit 122, the ADC 124 and/or digital processing circuit 126) to the second electrodes 308A and 308B, respectively. The state of the switches 120A and 120B may be controlled by switch control signals 312A and 312B respectively. These control signals may be generated based on, for example, an operating mode of the ultrasound circuit 300. For example, the ultrasound circuit may be operating in a transmit mode and the switches 120A and 120B may be open to avoid receiving the pulse signal from the pulsers 116A and 116B. Conversely, the switches 120A and 120B may be closed when the ultrasound circuit is operating in a receive mode to allow the receive circuit to detect signals from the MUTs 304A and 304B.

It should be appreciated that the receive circuit 112 may comprise more (or less) than two switches that selectively couple the second electrodes 308A and 308B to the receive circuit 112. For example, the switches 120A and 120B may be omitted in some embodiments. In these embodiments, a portion of the MUTs in a given differential MUT element may be hardwired to the receive circuit 112, the transmit circuit 110A, and/or the transmit circuit 110B. Such a configuration may reduce the transmit power and/or receive responsivity and advantageously eliminate any parasitic elements of the switches 120A and 120B. In other embodiments, the receive circuit 112 may comprise more than two switches (e.g., four switches) and/or a switch matrix that is configured to selectively couple each of the second electrodes 308A and 308B to two or more points in the analog processing circuit 122. For example, the second electrode 308A may be selectively coupled (e.g., using a switch matrix) to a first input terminal or a second input terminal of a TIA in the analog processing circuit 122.

Figure 11:
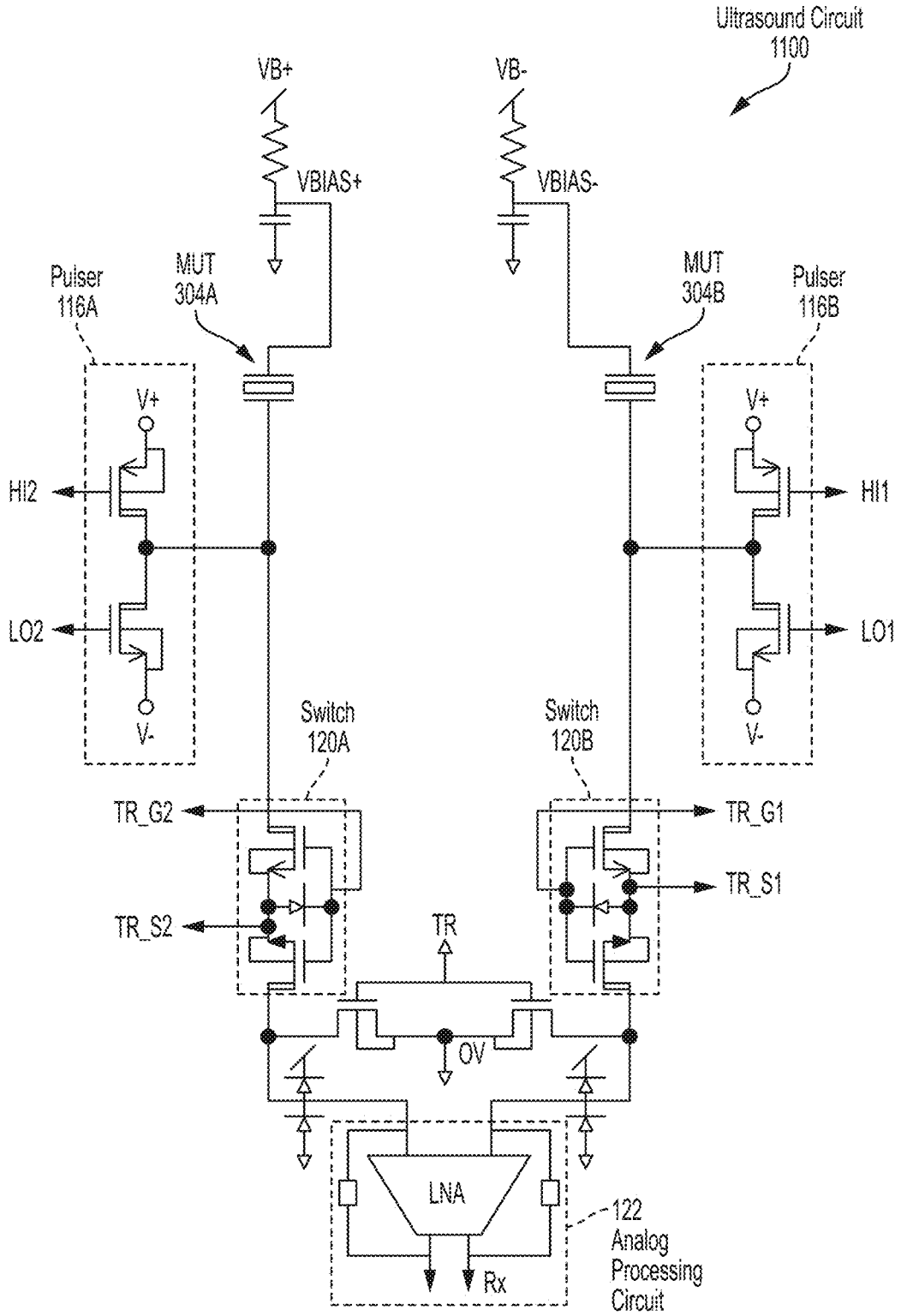
FIG. 11 shows a detailed diagram of the exemplary ultrasound circuit in FIG. 3 in accordance with some embodiments of the technology described herein.

FIG. 11 shows an ultrasound circuit 1100 that is a more detailed diagram of the ultrasound circuit 300. As shown, the ultrasound circuit 1100 comprises MUTs 304A and 304B that have a first electrode coupled to a positive bias voltage (VBIAS+) and a negative bias voltage (VBIAS−), respectively, and a second electrode coupled to pulsers 116A and 116B, respectively. As shown, the second electrode of the MUTs 304A and 304B may be switchably coupled to the analog processing circuit 122 by a set of transistors including, for example, those transistors in the switches 120A and 120B.

The pulsers 116A and 116B comprise two transistors coupled in series that are coupled between a positive supply voltage V+ and a negative supply voltage V−. The transistors in the pulsers 116A and 116B may be, for example, high-voltage transistors. The state of these transistors may be changed by control signals HI1, LO1, HI2, and LO2 (e.g., generated by a waveform generator) in, for example, a fully differential or pseudo differential fashion. These control signals may, for example, control the transistors to selectively couple the second electrode of the MUTs 304A and/or 304B to the positive supply voltage V+ or the negative supply voltage V− to drive the MUTs 304A and 304B. The pulsers 116A and 116B may be controlled independently to, for example, enable a differential transmit mode where the second electrodes of the MUTs 304A and 304B are coupled to the positive supply voltage V+ at different times. The design of the ultrasound circuit 1100 advantageously implements the pulsers 116A and 116B with fewer transistors than simply putting two single-ended pulsers together. Thereby, the ultrasound circuit 1100 may consume less power than conventional approaches during operation (e.g., during transmit operation).

The switches 120A and 120B comprise two transistors coupled in series and a diode coupled there-between. The transistors in the switches 120A and 120B may be, for example, high-voltage transistors. The state of these transistors may be changed by control signals TR_G1, TR_S1, TR_G2, and TR_S2 in, for example, a common-mode fashion (e.g., change states in unison). As shown, the switches 120A and 120B may be selectively coupled to each other by two transistors controlled by the control signal TR. These transistors between the switches 120A and 120B may be, for example, low voltage transistors.

The analog processing circuit 122 may comprise a low noise amplifier (LNA) with a first input that is coupled to the switch 120A and a second input that is coupled to the switch 120B. The LNA may comprise a first output coupled to the first input by a first impedance and a second output that is coupled to the second input by a second impedance. The LNA in combination with the first and second impedences may form a TIA. The outputs of the LNA may be provided to, for example, other components of the analog processing circuit 122 (not shown) and/or to an ADC (not shown).

Ultrasound circuits including differential MUT elements, such as the differential MUT elements described herein, may be operated in various modes. Example modes are described in connection with ultrasound circuit 300 and include: a differential receive mode, a single-ended receive mode, a differential transmit mode, and a single-ended transmit mode. Various combination of these modes may also be used, and the ultrasound circuit 300 may be configurable/controllable to allow for selection of a desired mode, or combination of modes, to suit a particular application. Example configurations of the ultrasound circuit 300 in each of these modes is shown in FIGS. 4A-4D. Table 1 below shows the particular mode of operation depicted in each of FIGS. 4A-4D.

TABLE 1

Example Modes of Operation of a Differential CMUT Ultrasound Device

Figure 4B:
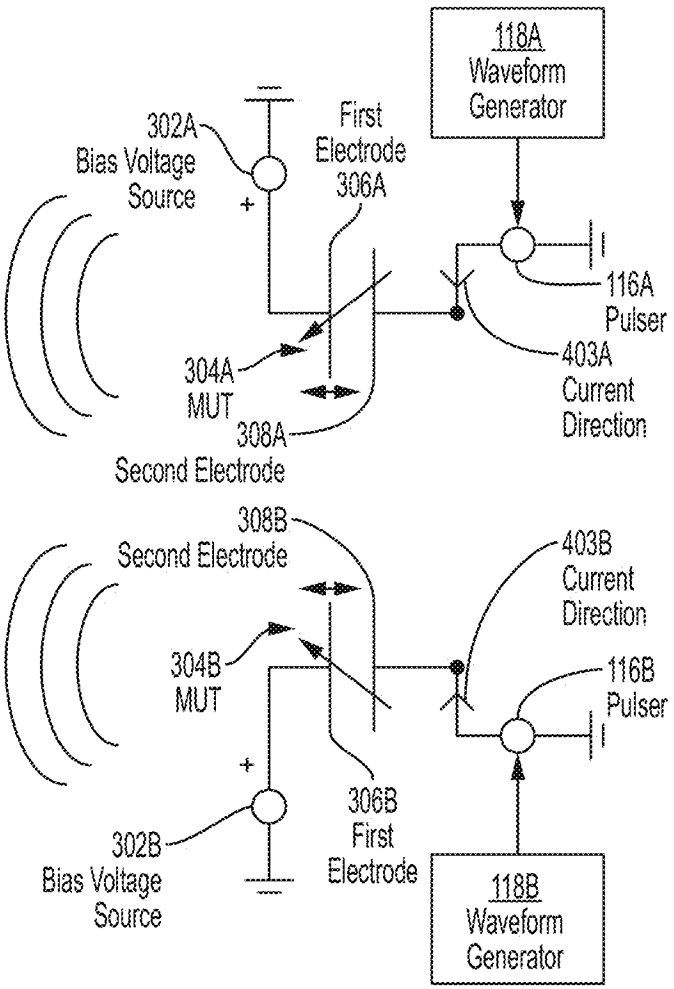
FIG. 4B shows the exemplary ultrasound circuit in FIG. 3 operating in a single-ended transmit mode, in accordance with some embodiments of the technology described herein.
Figure 4A:
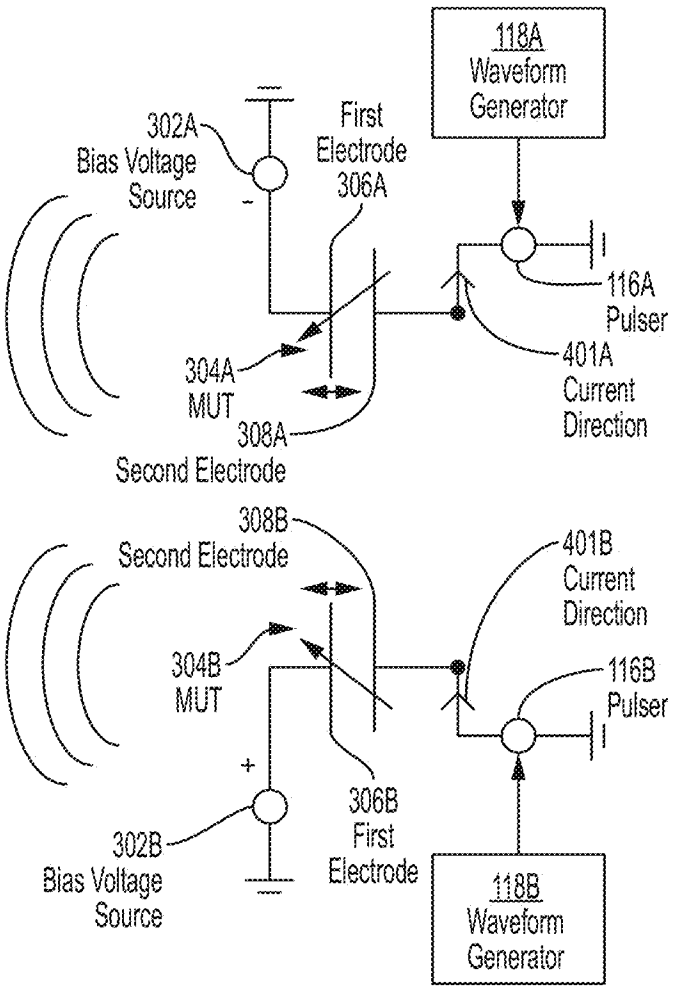
FIG. 4A shows the exemplary ultrasound circuit in FIG. 3 operating in a differential transmit mode, in accordance with some embodiments of the technology described herein.
Figure 4C:
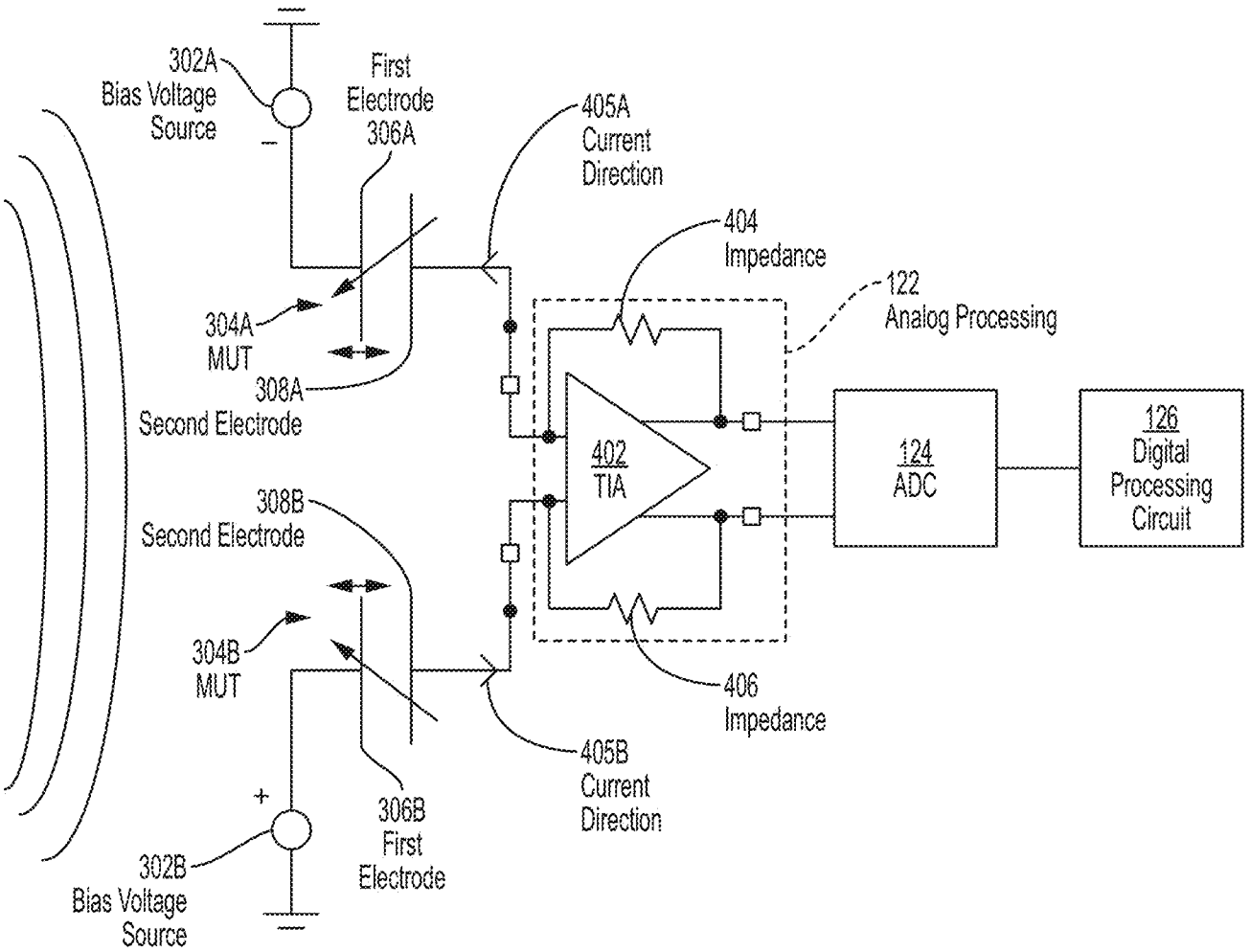
FIG. 4C shows the exemplary ultrasound circuit in FIG. 3 operating in a differential receive mode, in accordance with some embodiments of the technology described herein.
Figure 4D:
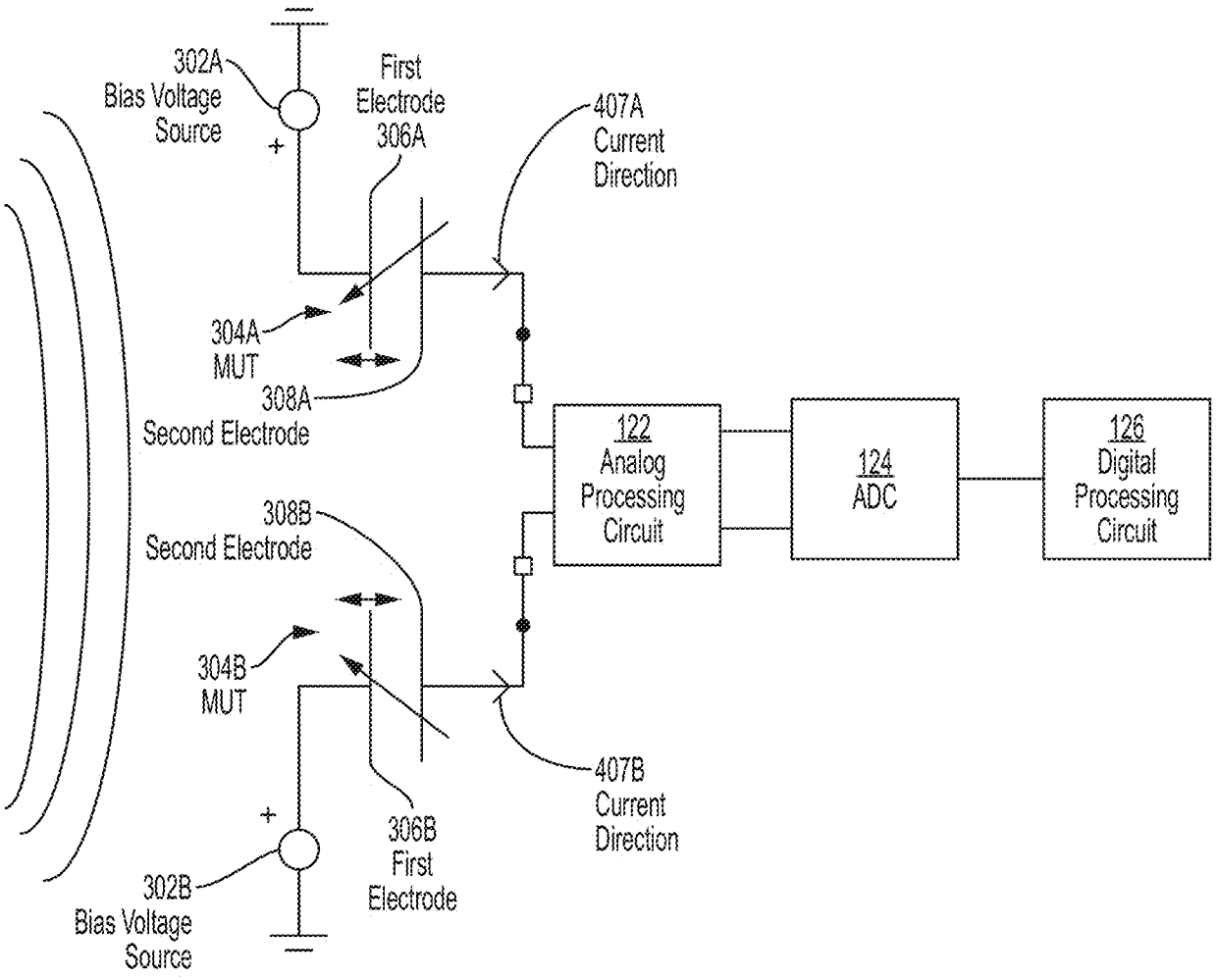
FIG. 4D shows the exemplary ultrasound circuit in FIG. 3 operating in a single-ended receive mode, in accordance with some embodiments of the technology described herein.

| Mode of Operation | FIG. Number |
|---|---|
| Differential transmit mode | FIG. 4A |
| Single-ended transmit mode | FIG. 4B |
| Differential receive mode | FIG. 4C |
| Single-ended receive mode | FIG. 4D |

FIG. 4A shows the ultrasound circuit 300 operating in a differential transmit mode. The differential transmit mode may be achieved, for example, by: (1) biasing MUTs 304A and 304B with bias voltages having an opposite polarity, (2) opening the switches 120A and 120B to disconnect the receive circuit 112 from the MUTs 304A and 304B, and (3) driving the MUTs 304A and 304B with pulse signals having an opposite polarity. In the differential transmit mode, the biasing of the MUTs 304A and 304B in combination with the pulse signals causes the MUTs 304A and 304B to be driven in unison (e.g., the first electrodes 306A and 306B may move in the same direction at the same time) while a direction of the current 401A in the top branch of the ultrasound circuit 300 is opposite a direction of the current 401B in a bottom branch of the ultrasound circuit 300. The opposite direction of current in the top and bottom branches of the circuit may advantageously reduce (or eliminate) ground bounce in the ultrasound circuit 300 that may impact operation of other components in the ultrasound circuit 300. For example, the currents in the top and bottom branches of the ultrasound circuit 300 may destructively interfere because these branch currents may have an approximately equal (and/or exactly equal) magnitude and opposite polarity. As a result, little or no current leaves from (or enters) the ground node during differential transmit operation, which advantageously reduces (or eliminates) ground bounce.

FIG. 4B shows the ultrasound circuit 300 operating in a single-ended transmit mode. The single-ended transmit mode may be achieved, for example, by: (1) biasing MUTs 304A and 304B with bias voltages having the same polarity, (2) opening the switches 120A and 120B to disconnect the receive circuit 112 from the MUTs 304A and 304B, and (3) driving the MUTs 304A and 304B with pulse signals that have the same polarity. In the single-ended transmit mode, the biasing of the MUTs 304A and 304B in combination with the pulse signals causes the MUTs 304A and 304B to be driven in unison (e.g., the first electrodes 306A and 306B may move in the same direction at the same time) while a direction of the current 403A in the top branch of the ultrasound circuit 300 is the same as a direction of the current 403B in a bottom branch of the ultrasound circuit 300.

FIG. 4C shows the ultrasound circuit 300 operating in a differential receive mode. The differential receive mode may be achieved, for example, by: (1) biasing MUTs 304A and 304B with bias voltages having an opposite polarity and (2) closing the switches 120A and 120B to connect the receive circuit 112 to the MUTs 304A and 304B. In the differential transmit mode, the biasing of the MUTs 304A and 304B causes a direction of the current 405A in the top branch of the ultrasound circuit 300 to be opposite a direction of the current 405B in a bottom branch of the ultrasound circuit 300. Thus, the receive circuit 112 may measure the difference between the signals from the MUTs 304A and 304B to identify characteristics of the acoustic signal incident on the MUTs 304A and 304B. Employing the difference between signals from the MUTs 304A and 304B may advantageously cancel out noise from noise sources that similarly impact the electrical signals from both MUTs 304A and 304B. The receive circuit 112 may measure the difference between the signals using a differential TIA 402 in the analog processing circuitry 122. The differential TIA 402 may have a first input coupled to the second electrode 308A, a second input coupled to the second electrode 308B, a first output coupled to the first input by an impedance 404, and a second output coupled to the second input by an impedance 406. The two outputs of the differential TIA 402 may be provided to additional circuitry within the analog processing circuit 122 (such as a variable-gain amplifier, a delay line, a time-gain-compensation amplifiers, a buffer, and/or a mixer) and then to the ADC 124 or provided directly to the ADC 124 (as shown in FIG. 4C). The ADC 124 may be implemented as, for example, a differential ADC that is configured to provide a digital value that is indicative of a difference between the voltages received at the two inputs.

FIG. 4D shows the ultrasound circuit 300 operating in a single-ended receive mode. The single-ended receive mode may be achieved, for example, by: (1) biasing the first electrodes 306A and 306B with bias voltages having the same polarity and (2) closing the switches 120A and 120B to connect the receive circuit 112 to the MUTs 304A and 304B. In the single-ended transmit mode, the biasing of the MUTs 304A and 304B causes a direction of the current 407A in the top branch of the ultrasound circuit 300 to be the same as a direction of the current 407B in a bottom branch of the ultrasound circuit 300. The receive circuit 112 may measure the signals from the MUTs 304A and 304B individually (e.g., without combining them). For example the receive circuit 112 may separately process and digitize the signals from the MUTs 304A and 304B.

In some embodiments, single-ended transmit and/or receive modes may allow fewer MUTs to be employed to obtain the same spatial resolution as differential transmit and/or receive modes without adversely impacting image quality in certain operating conditions where the signal-to-noise ratio is high (e.g., in shallow ultrasound imaging). In these embodiments, the ultrasound circuit may operate in single-ended transmit and/or single-ended receive modes to consume less power when operating in these conditions without noticeably degrading the resulting ultrasound image.

In some embodiments, the ultrasound circuit 300 may be configurable between a plurality of modes, such as two or more of the modes shown in Table 1. For example, the ultrasound circuit 300 may be configurable between: (1) a differential transmit mode and a differential receive mode; (2) a differential transmit mode and a single-ended receive mode; (3) a differential transmit mode, a single-ended receive mode, and a differential receive mode; (4) a single-ended transmit mode and a differential receive mode; (5) a single-ended transmit mode and a single-ended receive mode; (6) a single-ended transmit mode, a single-ended receive mode, and a differential receive mode; (7) a differential transmit mode, a single-ended transmit mode, and a differential receive mode; (8) a differential transmit mode, a single-ended transmit mode, and a single-ended receive mode; or (9) a differential transmit mode, a single-ended transmit mode, a single-ended receive mode, and a differential receive mode. The mode of operation of the ultrasound circuit 300 may be configurable using one or more control signals. The control signals may: (1) adjust a bias voltage applied by one or more of the bias voltage sources 302A and 302B such as voltage control signals 310A and 310B; (2) change a state of one or more of the switches 120A and 120B such as switch control signals 312A and 312B; and/or (3) change a waveform generated by one or more of the waveform generates 118A and 118B such as waveform control signals 314A and 314B. The control signals may be generated by control circuits (such as timing and control circuit 708 described below with reference to FIG. 7) that may be located on the same chip as the ultrasound circuit 300 or on a different chip.

Figure 5A:
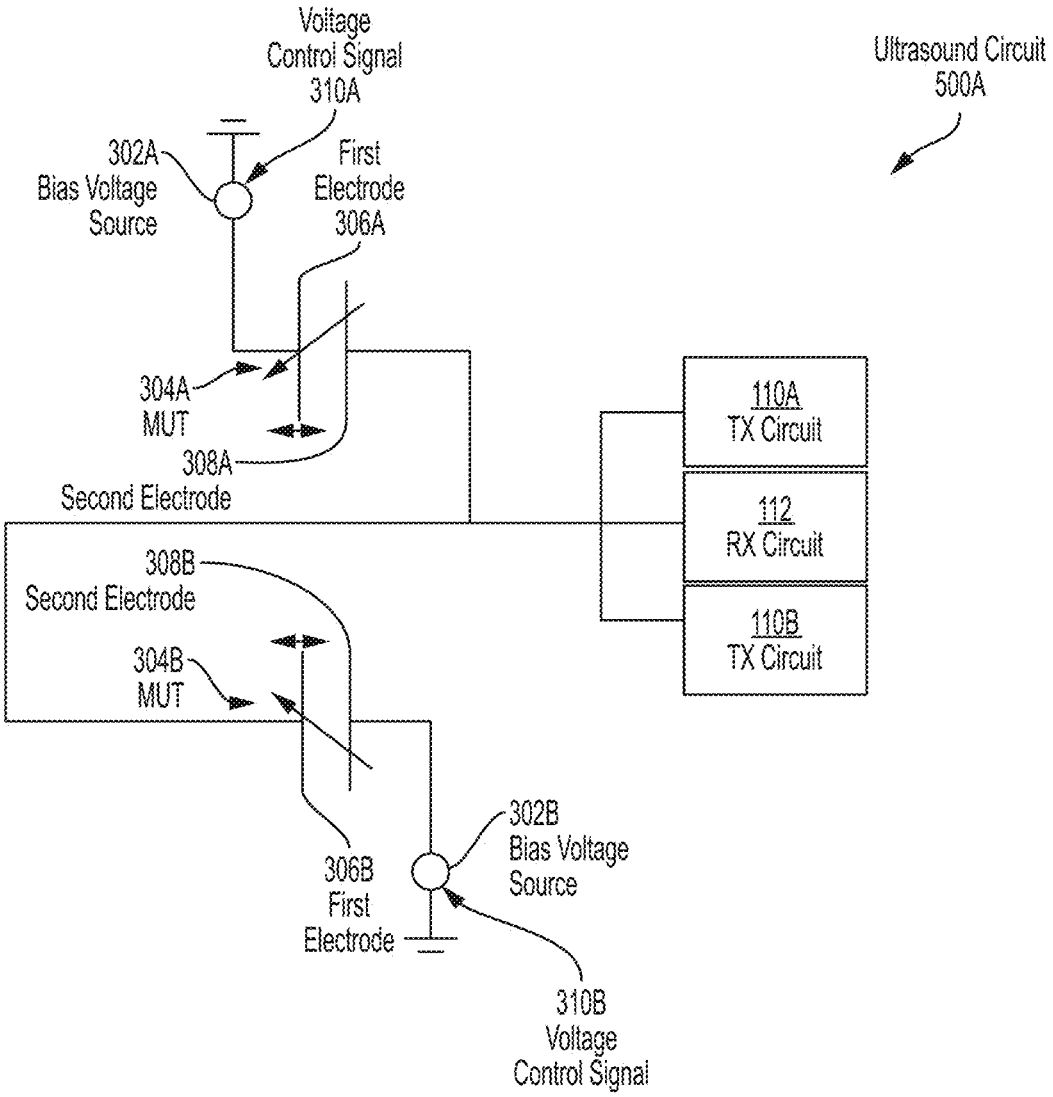
FIGS. 5A and 5B each show an exemplary ultrasound circuit including a differential MUT element.

It should be appreciated that the ultrasound circuit 300 may be coupled to the MUTs 304A and 304B in a different way than illustrated in FIG. 3. The particular way in which the ultrasound circuit 300 is coupled to the MUTs 304A and 304B may, for example, depend on the construction of the MUTs 304. In some embodiments, the MUTs 304A and 304B may be implemented as PMUTs where the polarity of the signal applied to the PMUTs may impact the performance of the PMUT. In these embodiments, the connections to the MUT 304B may be reversed relative to the connections to MUT 304A such that the current direction in the top and bottom branches of the ultrasound circuit 300 match during operation in a differential transmit mode and/or differential receive mode. An example of such an ultrasound circuit is shown in FIG. 5A by ultrasound circuit 500A. As shown, the connections to the first electrode 306B are swapped with the connections to the second electrode 308B relative to the configuration shown in ultrasound circuit 300. In particular, the TX circuits 110A and 110B and the RX circuit 120 are coupled to the second electrode 308A of the MUT 304A and coupled to the first electrode 306B of the MUT 304B. Further, the bias voltage source 302A is coupled to the first electrode 306A of the MUT 304A and the bias voltage source 302B is coupled to the second electrode 308B of the MUT 304B.

Figure 5B:
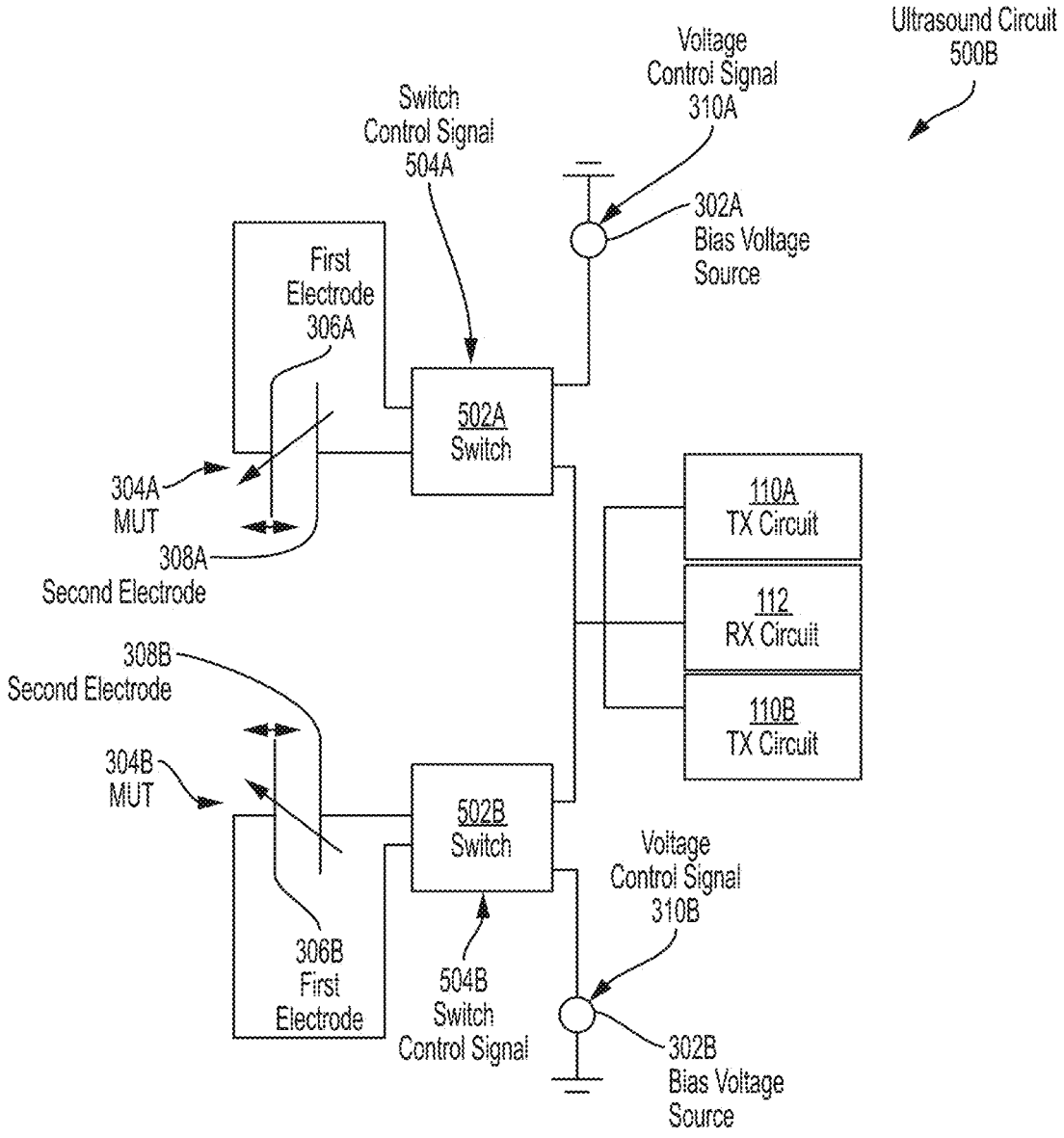

One or more switches may be integrated into the ultrasound circuits 300 and/or 500A to enable the connections to the electrodes of the MUTs 304A and/or 304B to be swapped based on, for example, a current mode of operation of the ultrasound circuit. In some embodiments, the switches may be controlled such that the current direction in the top and bottom branches of the ultrasound circuit 300 match during one or more of (or all of) the operation modes. Controlling the switches in such a fashion may, for example, advantageously improve the performance of ultrasound circuits implemented using PMUTs where the polarity of the signal applied to the PMUTs impacts the performance of the PMUT. In these embodiments, the switches may be controlled such that the bias voltage sources 302A and 302B are coupled to first electrodes 306A and 306B, respectively, during operation in single-ended transmit mode and/or single-ended receive mode and the bias voltage sources 302A and 302B are coupled to first electrode 306A and second electrode 308B, respectively, during operation in differential receive mode and/or differential transmit mode. An example of such an ultrasound circuit is shown in FIG. 5B by ultrasound circuit 500B. As shown, ultrasound circuit 500B adds switches 502A and 502B that are controlled using switch control signals 504A and 504B, respectively, relative to the ultrasound circuits 500A and 300 described above.

The switches 502A and 502B may each be constructed as, for example, a set of one or more switches that selectively couple any one of the inputs to any one of the outputs. For example, the switch 502A may be constructed to selectively couple the bias voltage source 302A to the first electrode 306A or the second electrode 308A and selectively couple the TX and RX circuits 110A, 110B, and 112 to the first electrode 306A or the second electrode 308A based on a received switch control signal 504A. The switch 502B may be constructed to selectively couple the bias voltage source 302B to the first electrode 306B or the second electrode 308B and selectively couple the TX and RX circuits 110A, 110B, and 112 to the first electrode 306B or the second electrode 308B based on a received switch control signal 504B. In a differential receive mode and/or a differential transmit mode, the switches 502A and/or 502B may be controlled such that the bias voltage sources 302A and 302B are coupled to first electrode 306A and second electrode 308B, respectively. Further, the bias voltage sources 302A and 302B may be controlled so as to generate output voltages with opposite polarities. In a single-ended receive mode and/or a single-ended transmit mode, the switches 502A and/or 502B may be controlled such that the bias voltage sources 302A and 302B are coupled to first electrodes 306A and 306B, respectively. Further, the bias voltage sources 302A and 302B may be controlled so as to generate output voltages with the same polarity (e.g., the same output voltage). Thus, the switches 502A and 502B may enable the ultrasound circuit 500B to change the direction in which current is applied to the MUTs 304A and/or 304B such that, for example, the direction of current applied to the MUT 304A matches the direction of current applied to the MUT 304B.

It should be appreciated that various alterations may be made to the ultrasound circuit 500B without departing from the scope of the present disclosure. In some embodiments, the ultrasound circuit 500B may omit one of the switches 502A and 502B. Thus, the direction in which current is applied to one of the MUTs may be fixed for a given mode of operation. In these embodiments, the remaining switch (e.g., either switch 502A or switch 502B) may be controlled such that the direction of current applied to the second MUT matches the direction of current applied to the first MUT in the given mode of operation. Thus, the same effect of matching the current direction in each of the top and bottom branches in the ultrasound circuit 500B may be achieved using a smaller number of switches.

Figure 6:
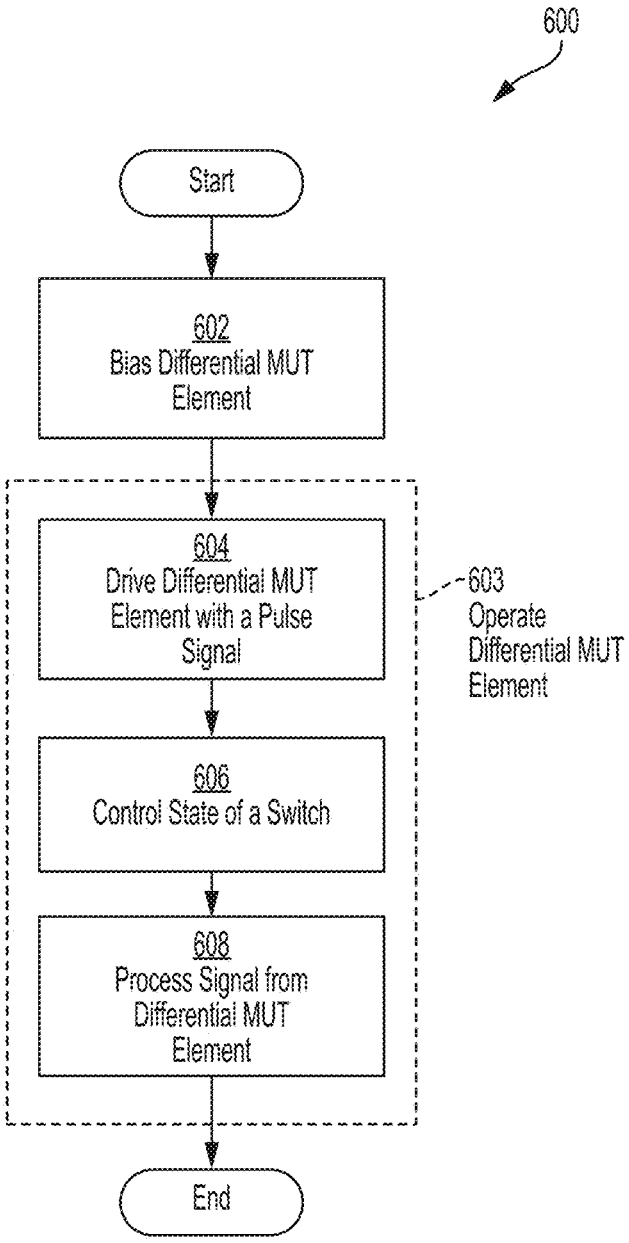
FIG. 6 shows an exemplary method of operating an ultrasound circuit comprising a differential MUT element, in accordance with some embodiments of the technology described herein.

FIG. 6 shows an example method 600 of operating an ultrasound circuit comprising a differential MUT element. As shown, the method 600 comprises an act 602 of biasing the differential MUT element and an act 603 of operating the differential MUT element. The act 603 of operating the differential MUT element may comprise, for example, an act 604 of driving the differential MUT element with a pulse signal, an act 606 of controlling a state of a switch, and an act 608 of receiving a signal from the differential MUT element.

In act 602, the differential MUT element may be biased. The differential MUT element may be biased by, for example, applying a bias voltage to one electrode of the MUT(s) in the differential MUT element. The bias voltages may be generated by, for example, bias voltage sources. These bias voltage sources may be variable voltage sources that are capable of providing a plurality of different voltages. In some embodiments, the variable voltage sources may be controlled using one or more control signals (e.g., generated by one or more control circuits) based on a particular mode of operation of the ultrasound circuit. For example, the ultrasound circuit may be operating in a single-ended receive or transmit mode and the variable voltage sources may be controlled such that all of the MUTs in the differential MUT element are biased with the same voltage. In another example, the ultrasound circuit may be operating in a differential receive or differential transmit mode and the variable voltage sources may be controlled such that a first portion of the MUTs in the differential MUT element are biased with a first voltage and a second portion of the MUTs in the differential element are biased with a second voltage that has an opposite polarity of the first voltage.

In act 603, the differential MUT element may be operated to transmit and/or receive acoustic signals based on a current mode of operation of the ultrasound circuit. For example, the differential MUT element may be operated to transmit acoustic signals when the ultrasound circuit is operating in a differential transmit or a single-ended transmit mode and operated to receive acoustic signals when the ultrasound circuit is operating in a differential receive or a single-ended receive mode.

The differential MUT element may be operated to transmit acoustic signals by, for example, performing act 604 of driving the differential MUT element with a pulse signal. The characteristics of the pulse signal that is applied to the differential MUT element may depend on whether the ultrasound circuit is operating in a differential transmit or a single-ended transmit mode. When the ultrasound circuit is operating in the single-ended transmit mode, the pulse signal provided to all of the MUTs in the differential MUT element may have the same polarity (and/or be the same signal). When the ultrasound circuit is operating in the differential transmit mode, the pulse signal provided to a first portion of the MUTs (e.g., a first half) in the MUT element may have a first polarity and the pulse signal provided to a second portion of the MUTs (e.g., a second half) in the differential MUT element have a second, opposite polarity.

The differential MUT element may be operated to receive acoustic signals by, for example, performing act 606 of controlling a state of a switch (e.g., switch 120) to couple receive circuit (e.g., receive circuit 112) to the differential MUT element and act 608 of processing a signal from the differential MUT element. The particular techniques employed to process the signal from the differential MUT element in act 608 may depend on whether the ultrasound circuit is operating in a differential receive or a single-ended receive mode. In the differential receive mode, the processing may comprise generating a digital signal representative of a difference between signals from two MUTs that are biased with voltages of an opposite polarity. In the single-ended receive mode, the processing may comprise generating a digital signal for each of the MUTs representative of the signal from the MUTs.

Various aspects of the technology described herein may be embodied as one or more processes, of which examples have been provided. The acts performed as part of each process may be ordered in any suitable way. Thus, embodiments may be constructed in which acts are performed in an order different than illustrated, which may include performing some acts simultaneously, even though shown as sequential acts in illustrative embodiments.

Example Ultrasound Device

Figure 7:
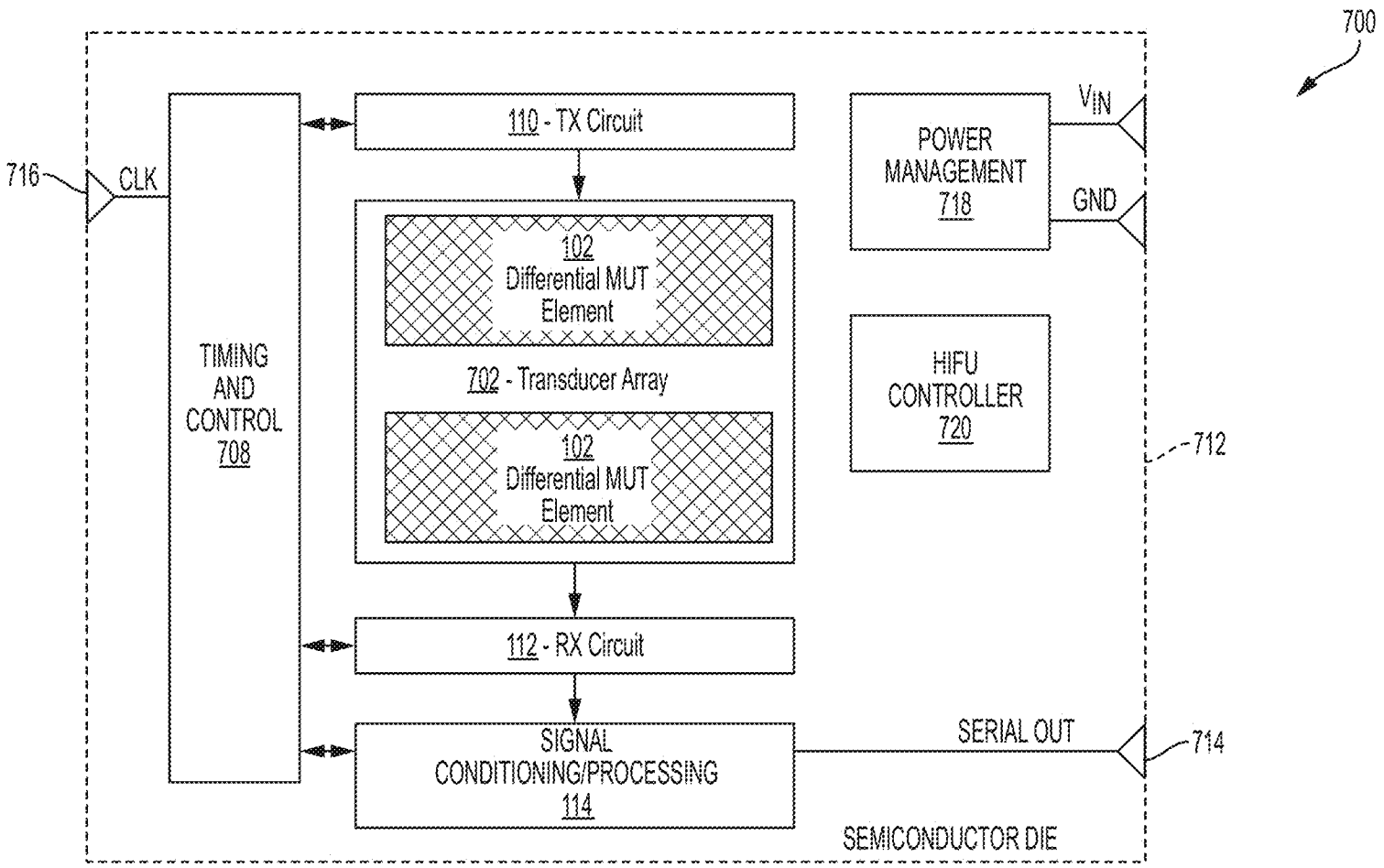
FIG. 7 shows an exemplary ultrasound device comprising the ultrasound circuit of FIG. 1A, in accordance with some embodiments of the technology described herein.

FIG. 7 shows the architecture of an ultrasound device 700 that employs differential MUT technology, such as the ultrasound circuits 100A and 100B described above. As shown, the ultrasound device 700 may include one or more transducer arrangements (e.g., arrays) 702, transmit (TX) circuit 110, receive (RX) circuit 112, a timing and control circuit 708, a signal conditioning/processing circuit 114, a power management circuit 718, and/or a high-intensity focused ultrasound (HIFU) controller 720. In the embodiment shown, all of the illustrated elements of FIG. 7 are formed on a single semiconductor die 712. Thus, the ultrasound device 700 may be a monolithic ultrasound device. It should be appreciated, however, that in alternative embodiments one or more of the illustrated elements may be instead located off-chip. In some embodiments, the illustrated components may be disposed on two or more chips. For example, the transducer array 702, a portion of the transmit circuit 110, and/or a portion of the receive circuit 112 may be on one die and the other components may be on one or more other dies. In addition, although the illustrated example shows both transmit circuit 110 and receive circuit 112, in alternative embodiments only transmit circuit 110 or only receive circuit 112 may be employed. For example, such embodiments may be employed in a circumstance where one or more transmission-only ultrasound devices 700 are used to transmit acoustic signals and one or more reception-only ultrasound devices 700 are used to receive acoustic signals that have been transmitted through or reflected off of a subject being ultrasonically imaged.

It should be appreciated that communication between one or more of the illustrated components may be performed in any of numerous ways. In some embodiments, for example, one or more high-speed busses (not shown), such as that employed by a unified Northbridge, may be used to allow high-speed intra-chip communication or communication with one or more off-chip components.

The one or more transducer arrays 702 may take on any of numerous forms, and aspects of the present technology do not necessarily require the use of any particular type or arrangement of transducer cells or transducer elements. Indeed, although the term "array" is used in this description, it should be appreciated that in some embodiments the transducer elements may not be organized in an array and may instead be arranged in some non-array fashion. As shown in FIG. 7, the transducer array 702 may comprise one or more differential MUT elements 102. It should be appreciated that other transducer elements may be employed in place of or in conjunction with the differential MUT elements 102. For example, the array transducer 702 may comprise one or more CMOS ultrasonic transducers (CUTs) and/or one or more other suitable ultrasonic transducers. In some embodiments, the transducer elements (e.g., differential MUT elements 102) of the transducer array 702 may be formed on the same chip as the electronics of the transmit circuit 110 and/or receive circuit 112. The transducer array 702, transmit circuit 110, and receive circuit 112 may, in some embodiments, be integrated in a single ultrasound device. In some embodiments, the single ultrasound device may be a handheld device. In other embodiments, the single ultrasound device may be embodied in a patch that may be coupled to a patient. The patch may be configured to transmit, wirelessly, data collected by the patch to one or more external devices for further processing.

A MUT may, for example, include a cavity formed in a metal oxide semiconductor (MOS) wafer (e.g., a complementary MOS (or "CMOS") wafer), with a membrane overlying the cavity, and in some embodiments sealing the cavity. Electrodes may be provided to create a transducer cell from the covered cavity structure. The MUT may include a piezoelectric layer sandwiched between the electrodes (e.g., in a PMUT implementation). The CMOS wafer may include an integrated circuit (e.g., integrated circuit 108) to which the transducer cell may be connected. The transducer cell and CMOS wafer may be monolithically integrated, thus forming an integrated ultrasonic transducer cell and integrated circuit on a single substrate (the CMOS wafer).

The transmit circuit 110 (if included) may, for example, generate pulses that drive the individual elements of, or one or more groups of elements within, the transducer array(s) 702 so as to generate acoustic signals to be used for imaging. The receive circuit 112, on the other hand, may receive and process electronic signals generated by the individual elements of the transducer array(s) 702 when acoustic signals impinge upon such elements.

In some embodiments, the timing and control circuit 708 may, for example, be responsible for generating all timing and control signals that are used to synchronize and coordinate the operation of the other elements in the device 700. In the example shown, the timing and control circuit 708 is driven by a single clock signal CLK supplied to an input port 716. The clock signal CLK may, for example, be a high-frequency clock used to drive one or more of the on-chip circuit components. In some embodiments, the clock signal CLK may, for example, be a 1.5625 GHz or 2.5 GHz clock used to drive a high-speed serial output device (not shown in FIG. 7) in the signal conditioning/processing circuit 114, or a 20 Mhz or 40 MHz clock used to drive other digital components on the semiconductor die 712, and the timing and control circuit 708 may divide or multiply the clock CLK, as necessary, to drive other components on the semiconductor die 712. In other embodiments, two or more clocks of different frequencies (such as those referenced above) may be separately supplied to the timing and control circuit 708 from an off-chip source.

The power management circuit 718 may, for example, be responsible for converting one or more input voltages VIN from an off-chip source into voltages needed to carry out operation of the chip, and for otherwise managing power consumption within the device 700. In some embodiments, for example, a single voltage (e.g., 12V, 80V, 100V, 120V, etc.) may be supplied to the chip and the power management circuit 718 may step that voltage up or down, as necessary, using a charge pump circuit or via some other DC-to-DC voltage conversion mechanism. In other embodiments, multiple different voltages may be supplied separately to the power management circuit 718 for processing and/or distribution to the other on-chip components.

As shown in FIG. 7, in some embodiments, a high-intensity focused ultrasound (HIFU) controller 720 may be integrated on the semiconductor die 712 so as to enable the generation of HIFU signals via one or more elements of the transducer array(s) 702. In other embodiments, a HIFU controller for driving the transducer array(s) 702 may be located off-chip, or even within a device separate from the device 700. That is, aspects of the present disclosure relate to provision of ultrasound-on-a-chip HIFU systems, with and without ultrasound imaging capability. It should be appreciated, however, that some embodiments may not have any HIFU capabilities and thus may not include a HIFU controller 720.

Moreover, it should be appreciated that the HIFU controller 720 may not represent distinct circuit in those embodiments providing HIFU functionality. For example, in some embodiments, the remaining circuit of FIG. 7 (other than the HIFU controller 720) may be suitable to provide ultrasound imaging functionality and/or HIFU, i.e., in some embodiments the same shared circuit may be operated as an imaging system and/or for HIFU. Whether or not imaging or HIFU functionality is exhibited may depend on the power provided to the system. HIFU typically operates at higher powers than ultrasound imaging. Thus, providing the system a first power level (or voltage level) appropriate for imaging applications may cause the system to operate as an imaging system, whereas providing a higher power level (or voltage level) may cause the system to operate for HIFU. Such power management may be provided by off-chip control circuit in some embodiments.

In addition to using different power levels, imaging and HIFU applications may utilize different waveforms. Thus, waveform generation circuit may be used to provide suitable waveforms for operating the system as either an imaging system or a HIFU system.

In some embodiments, the system may operate as both an imaging system and a HIFU system (e.g., capable of providing image-guided HIFU). In some such embodiments, the same on-chip circuit may be utilized to provide both functions, with suitable timing sequences used to control the operation between the two modalities.

In the example shown, one or more output ports 714 may output a high-speed serial data stream generated by one or more components of the signal conditioning/processing circuit 114. Such data streams may, for example, be generated by one or more USB 3.0 modules, and/or one or more 10 GB, 40 GB, or 100 GB Ethernet modules, integrated on the semiconductor die 712. In some embodiments, the signal stream produced on output port 714 can be fed to a computer, tablet, or smartphone for the generation and/or display of 2-dimensional, 3-dimensional, and/or tomographic images. In embodiments in which image formation capabilities are incorporated in the signal conditioning/processing circuit 114, even relatively low-power devices, such as smartphones or tablets which have only a limited amount of processing power and memory available for application execution, can display images using only a serial data stream from the output port 714. As noted above, the use of on-chip analog-to-digital conversion and a high-speed serial data link to offload a digital data stream is one of the features that helps facilitate an "ultrasound on a chip" solution according to some embodiments of the technology described herein.

Devices 700 such as that shown in FIG. 7 may be used in any of a number of imaging and/or treatment (e.g., HIFU) applications, and the particular examples discussed herein should not be viewed as limiting. In one illustrative implementation, for example, an imaging device including an N×M planar or substantially planar array of CMUT elements may itself be used to acquire an ultrasonic image of a subject, e.g., a person's abdomen, by energizing some or all of the elements in the array(s) 702 (either together or individually) during one or more transmit phases, and receiving and processing signals generated by some or all of the elements in the array(s) 702 during one or more receive phases, such that during each receive phase the CMUT elements sense acoustic signals reflected by the subject. In other implementations, some of the elements in the array(s) 702 may be used only to transmit acoustic signals and other elements in the same array(s) 702 may be simultaneously used only to receive acoustic signals. Moreover, in some implementations, a single imaging device may include a P×Q array of individual devices, or a P×Q array of individual N×M planar arrays of CMUT elements, which components can be operated in parallel, sequentially, or according to some other timing scheme so as to allow data to be accumulated from a larger number of CMUT elements than can be embodied in a single device 700 or on a single die 712.

In yet other implementations, a pair of imaging devices can be positioned so as to straddle a subject, such that one or more CMUT elements (e.g., differential CMUT elements) in the device(s) 700 of the imaging device on one side of the subject can sense acoustic signals generated by one or more CMUT elements in the device(s) 700 of the imaging device on the other side of the subject, to the extent that such pulses were not substantially attenuated by the subject. Moreover, in some implementations, the same device 700 can be used to measure both the scattering of acoustic signals from one or more of its own CMUT elements as well as the transmission of acoustic signals from one or more of the CMUT elements disposed in an imaging device on the opposite side of the subject.

Example Forms of Ultrasound Devices

The ultrasound devices described herein may be implemented in any of a variety of physical configurations, or form factors, including as part of a handheld device (which may include a screen to display obtained images) or as part of a patch configured to be affixed to the subject. Several examples are now described.

An ultrasound device may be implemented in any of a variety of physical configurations including as part of a pill to be swallowed by a subject, as part of a handheld device including a screen to display obtained images, or as part of a patch configured to be affixed to the subject.

Figure 8A:
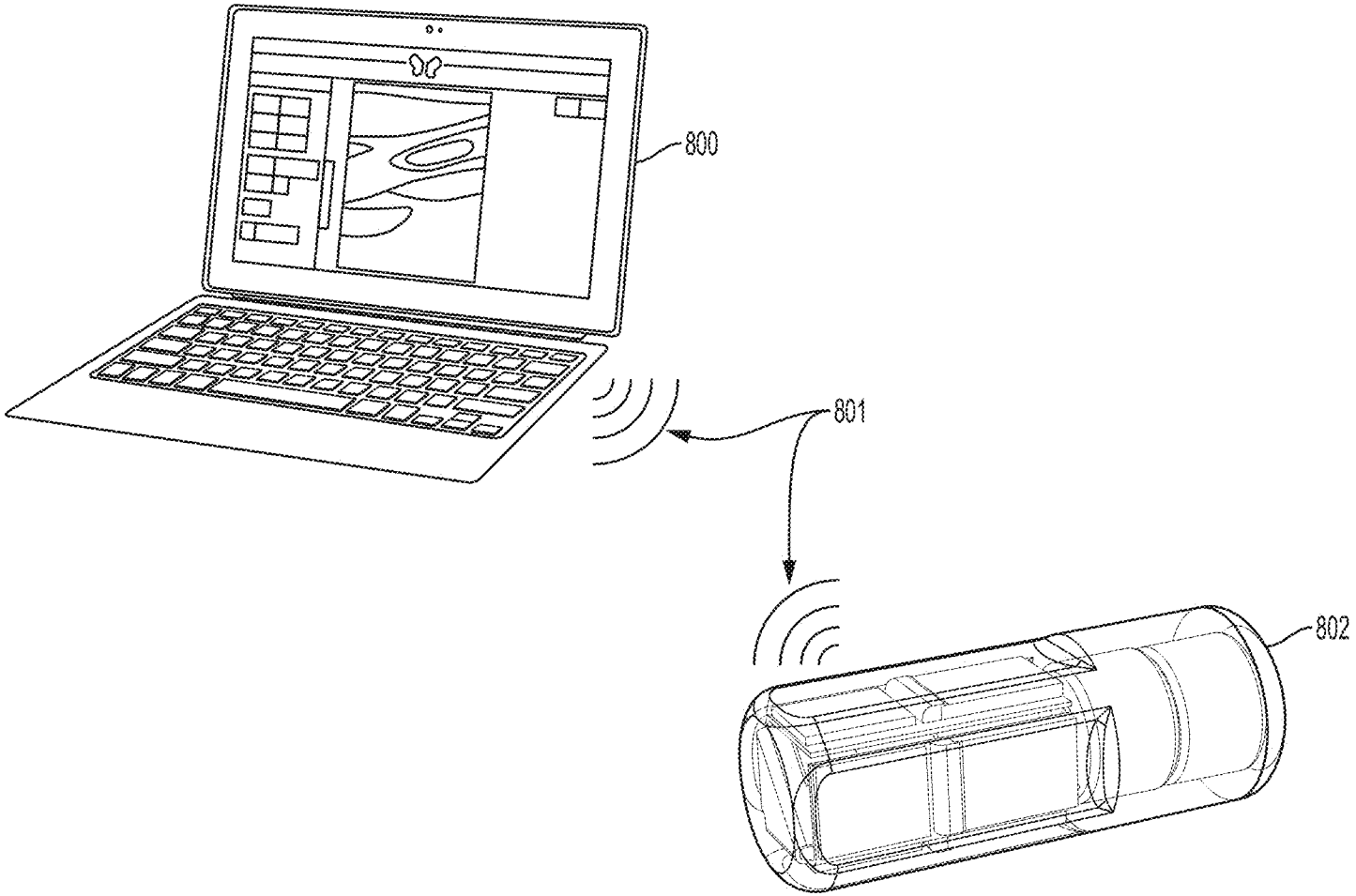
FIGS. 8A-8H show a pill comprising an ultrasound device, in accordance with some embodiments of the technology described herein.

In some embodiments, a ultrasound device may be embodied in a pill to be swallowed by a subject. As the pill travels through the subject, the ultrasound device within the pill may image the subject and wirelessly transmit obtained data to one or more external devices for processing the data received from the pill and generating one or more images of the subject. For example, as shown in FIG. 8A, pill 802 comprising an ultrasound device may be configured to communicate wirelessly (e.g., via wireless link 801) with external device 800, which may be a desktop, a laptop, a handheld computing device, and/or any other device external to pill 802 and configured to process data received from pill 802. A person may swallow pill 802 and, as pill 802 travels through the person's digestive system, pill 802 may image the person from within and transmit data obtained by the ultrasound device within the pill to external device 800 for further processing.

Figure 8B:
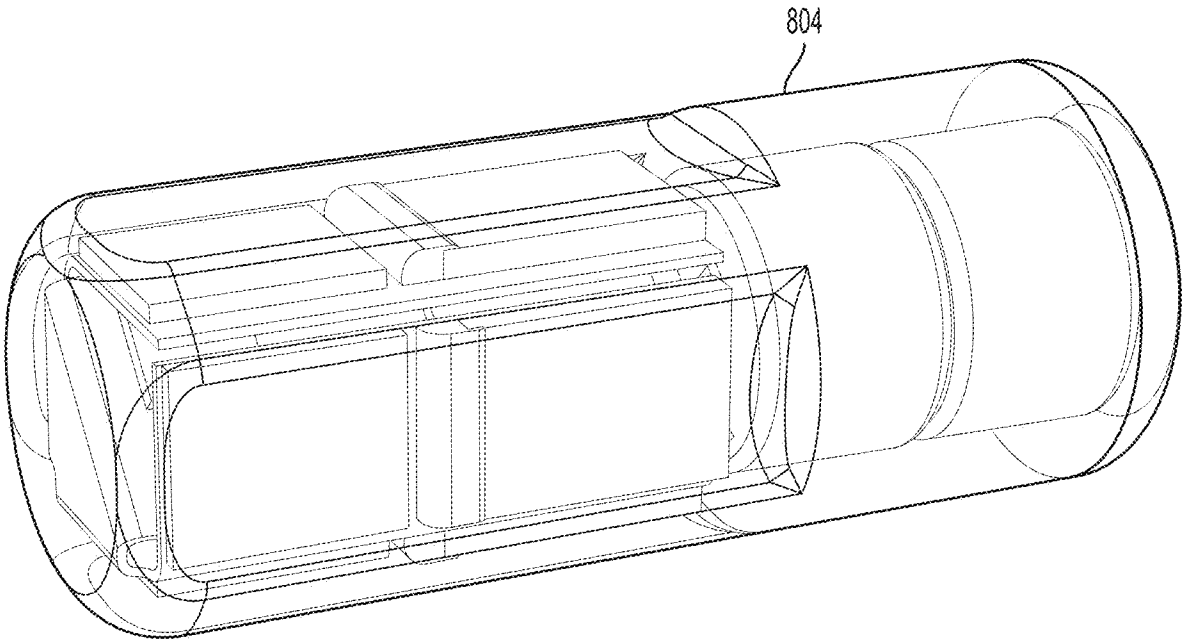
Figure 8C:
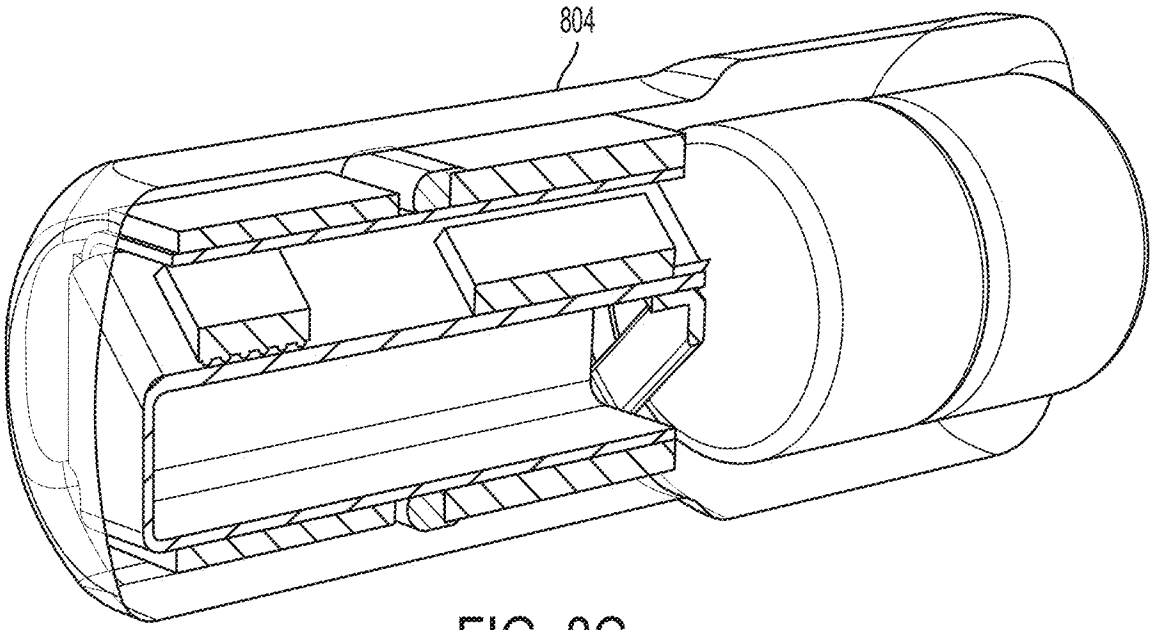
Figure 8D:
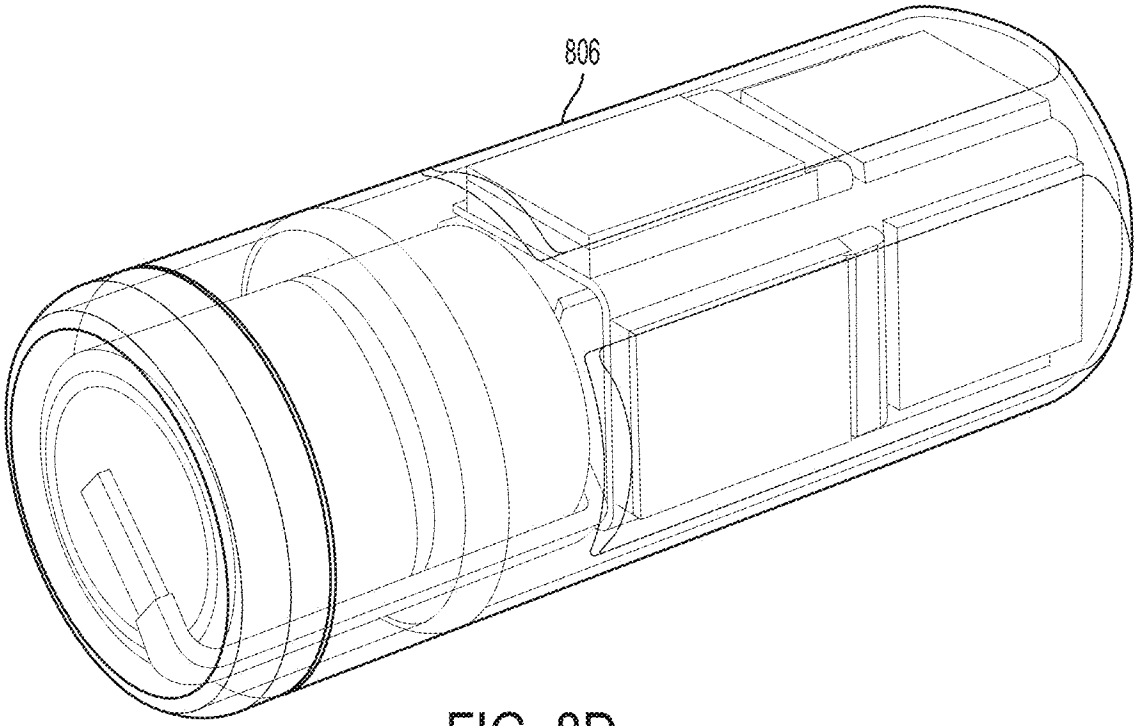
Figure 8E:
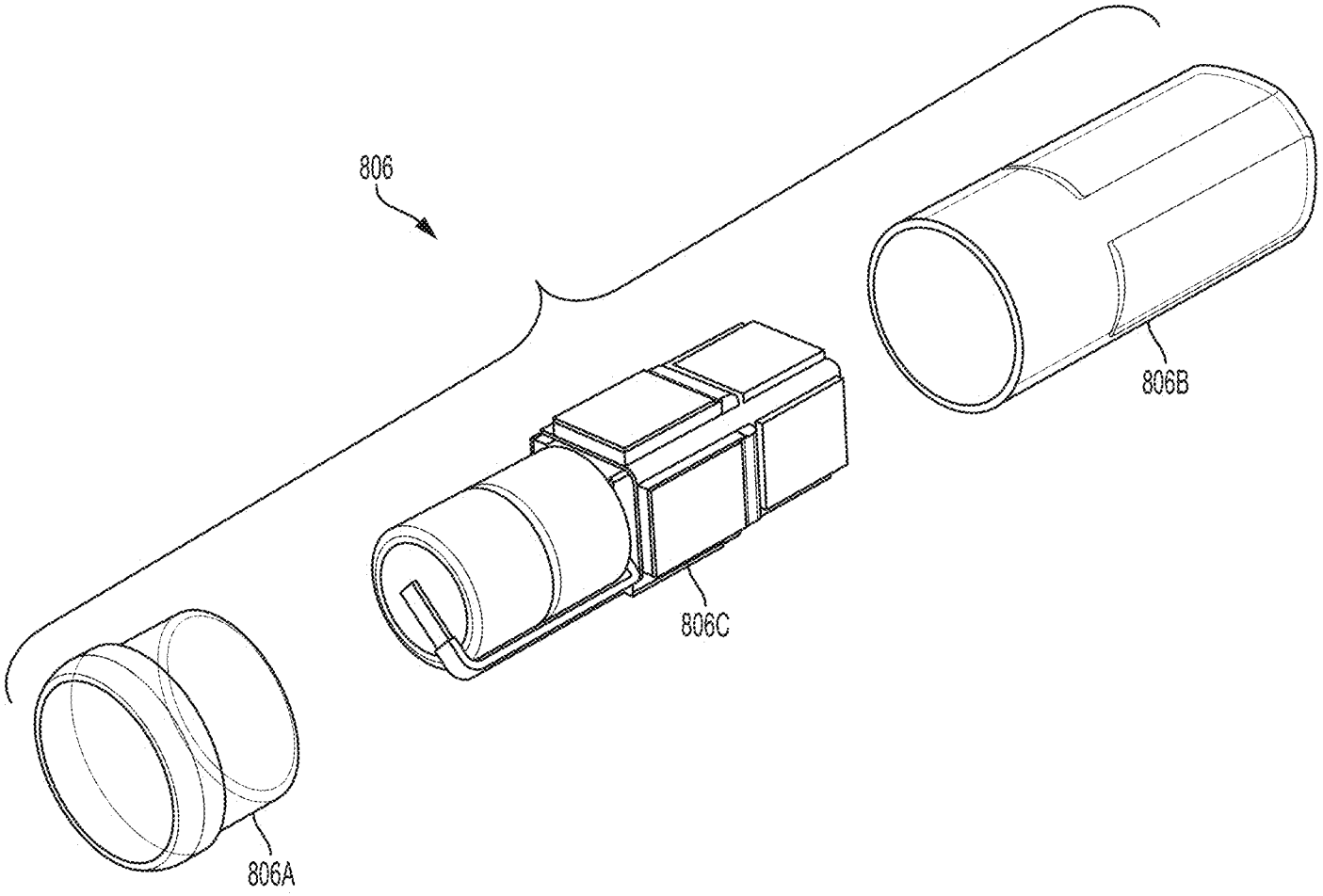

In some embodiments, a pill comprising an ultrasound device may be implemented by potting the ultrasound device within an outer case, as illustrated by an isometric view of pill 804 shown in FIG. 8B. FIG. 8C is a section view of pill 804 shown in FIG. 8B exposing views of the electronic assembly and batteries. In some embodiments, a pill comprising an ultrasound device may be implemented by encasing the ultrasound device within an outer housing, as illustrated by an isometric view of pill 806 shown in FIG. 8D. FIG. 8E is an exploded view of pill 806 shown in FIG. 8D showing outer housing portions 806A and 806B used to encase electronic assembly 806C.

Figure 8F:
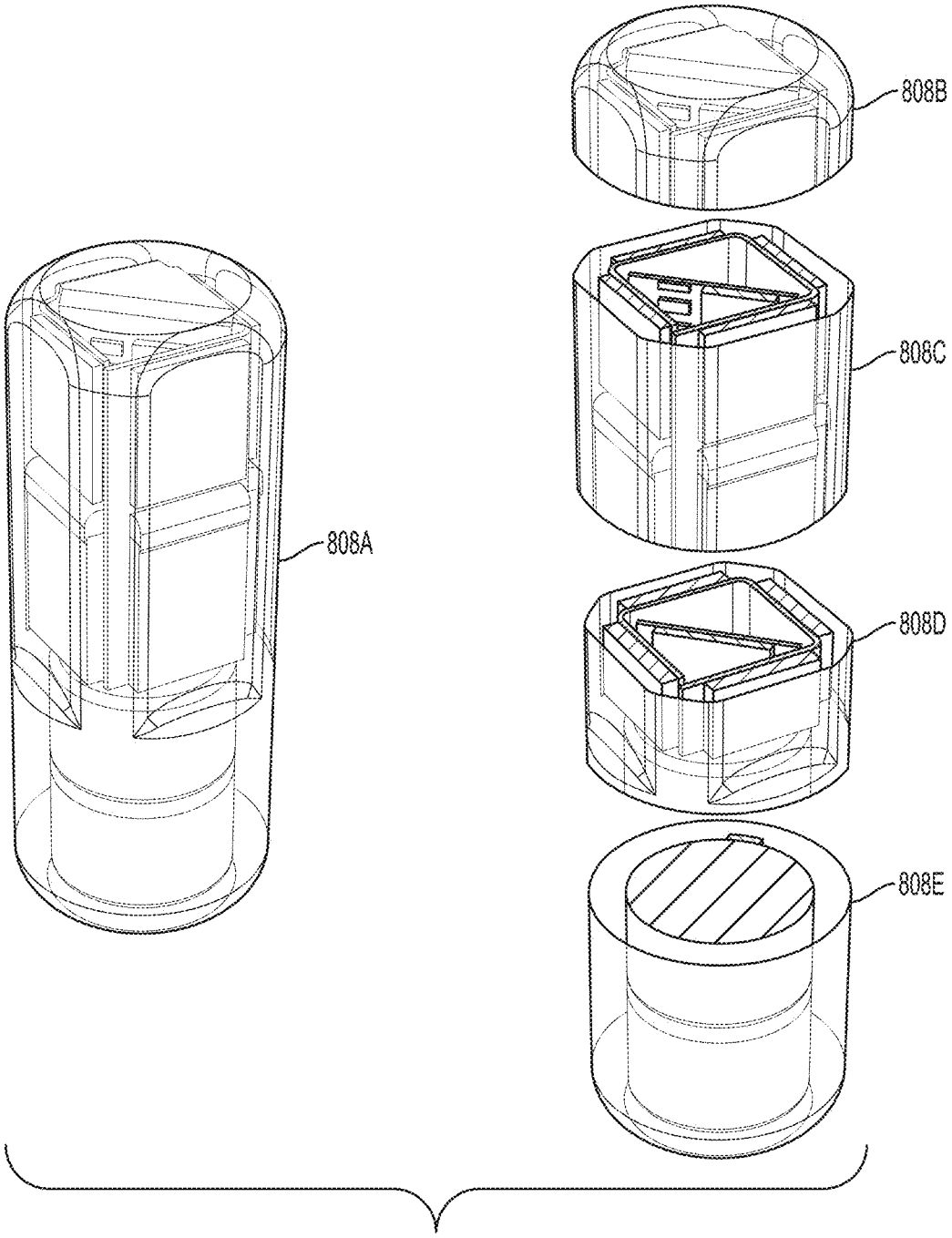

In some embodiments, the ultrasound device implemented as part of a pill may comprise one or multiple ultrasonic transducer (e.g., CMUT) arrays, one or multiple image reconstruction chips, an FPGA, communications circuit, and one or more batteries. For example, as shown in FIG. 8F, pill 808A may include multiple ultrasonic transducer arrays shown in sections 808B and 808C, multiple image reconstruction chips as shown in sections 808C and 808D, a WiFi chip as shown in section 808D, and batteries as shown in sections 808D and 808E.

Figure 8G:
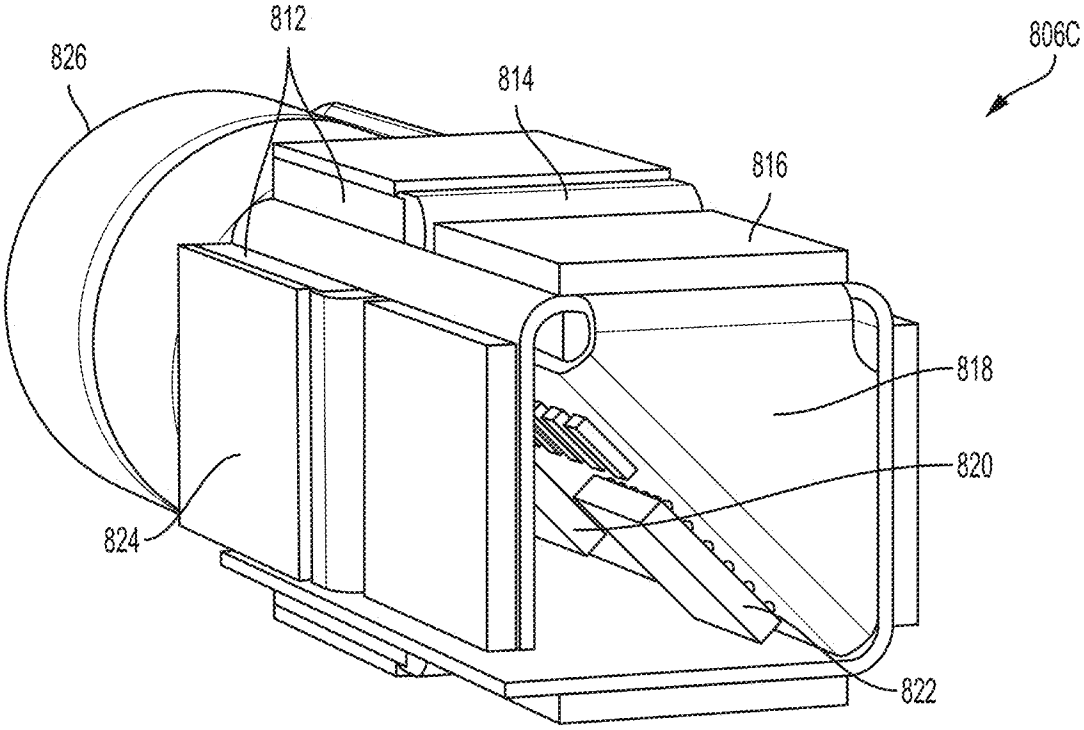
Figure 8H:
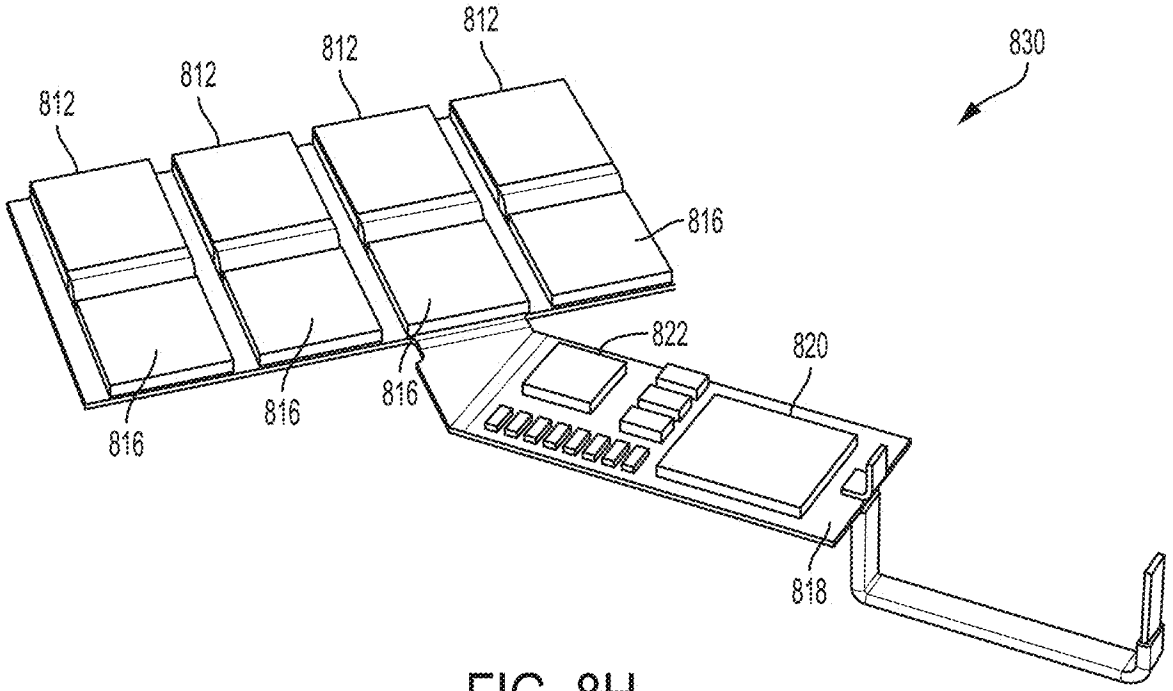

FIGS. 8G and 8H further illustrate the physical configuration of electronics module 806C shown in FIG. 8E. As shown in FIGS. 8G and 8H, electronics module 806C includes four CMUT arrays 812 (though more or fewer CMUT arrays may be used in other embodiments), bond wire encapsulant 814, four image reconstruction chips 816 (though more or fewer image reconstruction chips may be used in other embodiments), flex circuit 818, WiFi chip 820, FPGA 822, and batteries 822. Each of the batteries may be of size 13 PR48. Each of the batteries may be a 300 mAh 1.4V battery. Other batteries may be used, as aspects of the technology described herein are not limited in this respect.

In some embodiments, the ultrasonic transducers of an ultrasound device in a pill are physically arranged such that the field of view of the device within the pill is equal to or as close to 360 degrees as possible. For example, as shown in FIGS. 8G and 8H, each of the four CMUT arrays may a field of view of approximately 60 degrees (30 degrees on each side of a vector normal to the surface of the CMUT array) or a field of view in a range of 40-80 degrees such that the pill consequently has a field of view of approximately 240 degrees or a field of view in a range of 160-320 degrees.

Figure 9A:
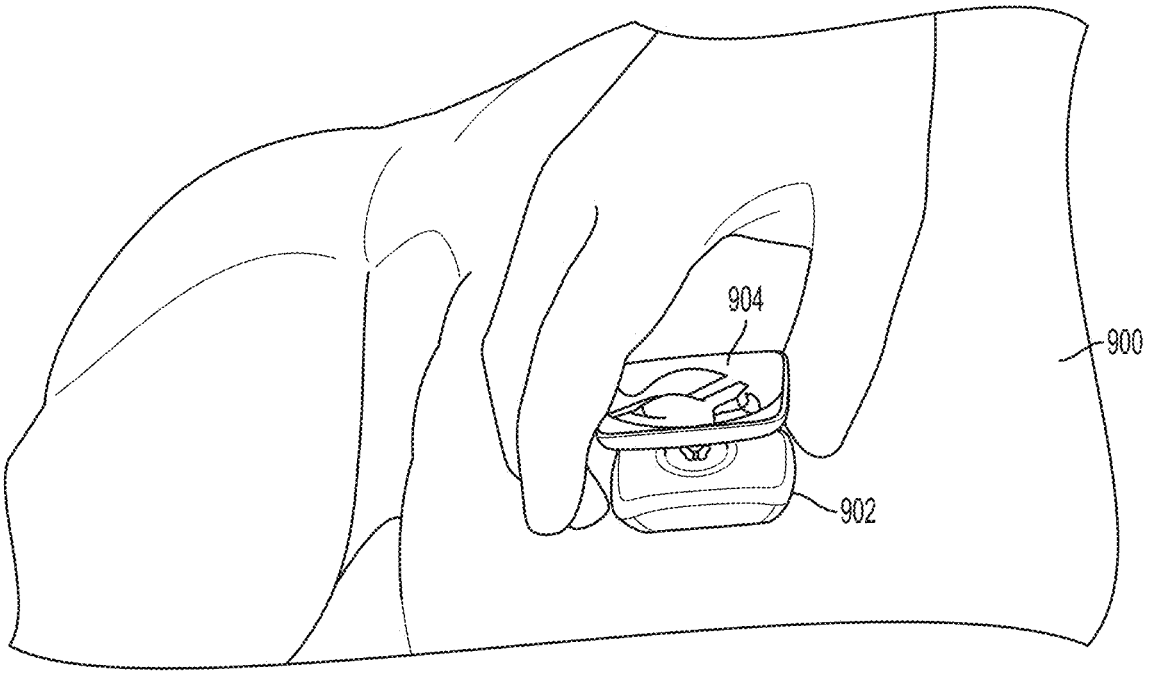
FIGS. 9A and 9B show a handheld device comprising an ultrasound device and a display, in accordance with some embodiments of the technology described herein.
Figure 9B:
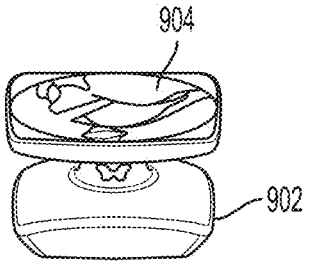

In some embodiments, a ultrasound device may be embodied in a handheld device 902 illustrated in FIGS. 9A and 9B. Handheld device 902 may be held against (or near) a subject 900 and used to image the subject. Handheld device 902 may comprise an ultrasound device (e.g., a ultrasound device) and display 904, which in some embodiments, may be a touchscreen. Display 904 may be configured to display images of the subject generated within handheld device 902 using ultrasound data gathered by the ultrasound device within device 902.

In some embodiments, handheld device 902 may be used in a manner analogous to a stethoscope. A medical professional may place handheld device 902 at various positions along a patient's body. The ultrasound device within handheld device 902 may image the patient. The data obtained by the ultrasound device may be processed and used to generate image(s) of the patient, which image(s) may be displayed to the medical professional via display 904. As such, a medical professional could carry hand-held device (e.g., around their neck or in their pocket) rather than carrying around multiple conventional devices, which is burdensome and impractical.

Figure 9C:
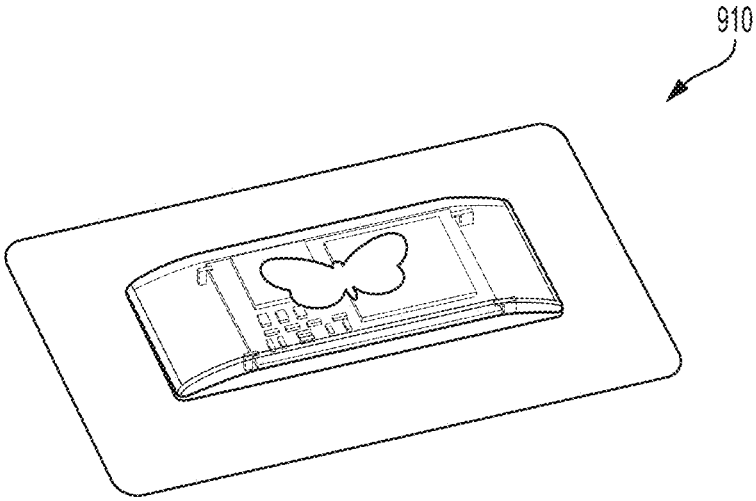
FIGS. 9C-9E show a wearable patch comprising an ultrasound device, in accordance with some embodiments of the technology described herein.
Figure 9D:
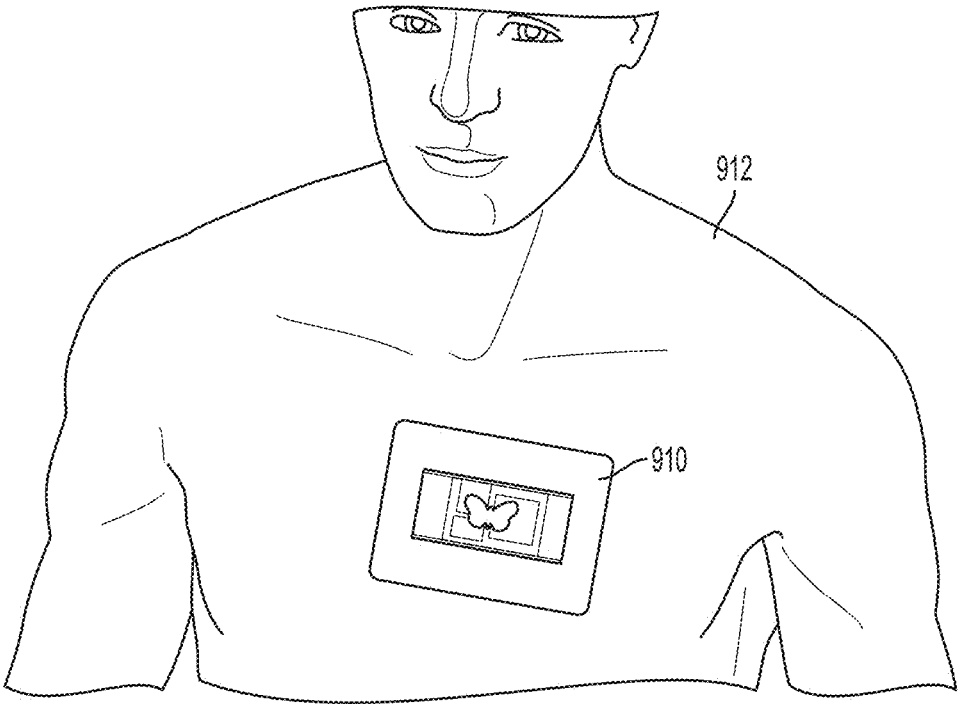

In some embodiments, an ultrasound device may be embodied in a patch that may be coupled to a patient. For example, FIGS. 9C and 9D illustrate a patch 910 coupled to patient 912. The patch 910 may be configured to transmit, wirelessly, data collected by the patch 910 to one or more external devices for further processing.

Figure 9E:
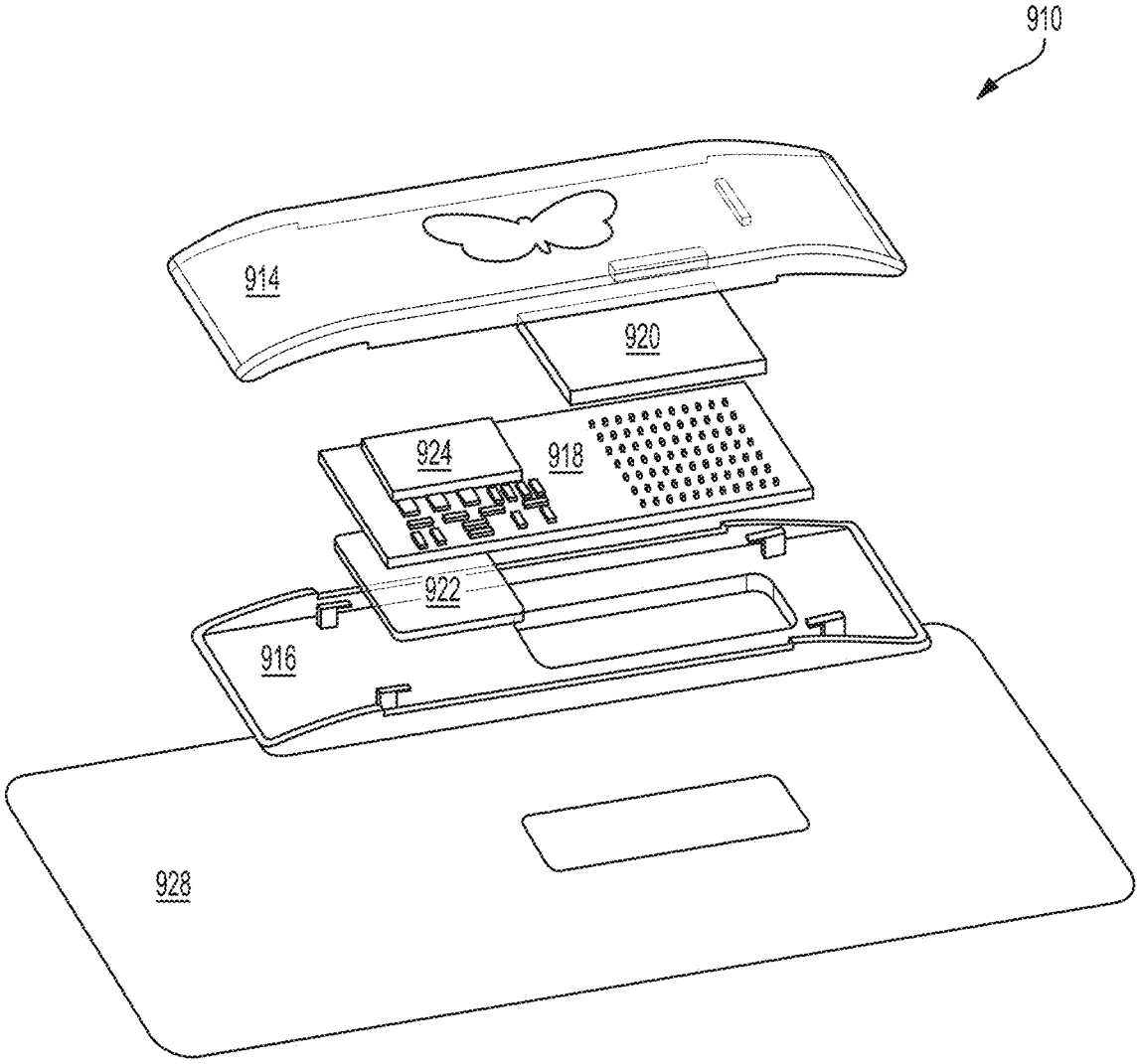

FIG. 9E shows an exploded view of patch 910. As particularly illustrated in FIG. 9E, patch 910 comprises upper housing 914, lower housing 916, and circuit board 918 disposed there between. The circuit board 918 may be configured to support various components, such as for example a heat sink 920, a battery 922, and communications circuitry 924. In one embodiment, communication circuitry 924 includes one or more short- or long-range communication platforms. Exemplary short-range communication platforms include, Bluetooth, Bluetooth Low Energy (BLE), and Near-Field Communication (NFC). Long-range communication platforms include, WiFi and Cellular. As further depicted in FIG. 9E, the patch 910 may also comprise dressing 928 that provides an adhesive surface for both the lower housing 916 as well as to the skin of a patient. One non-limiting example of such a dressing 928 is TEGADERM, a transparent medical dressing available from 3M Corporation.

Figure 10:
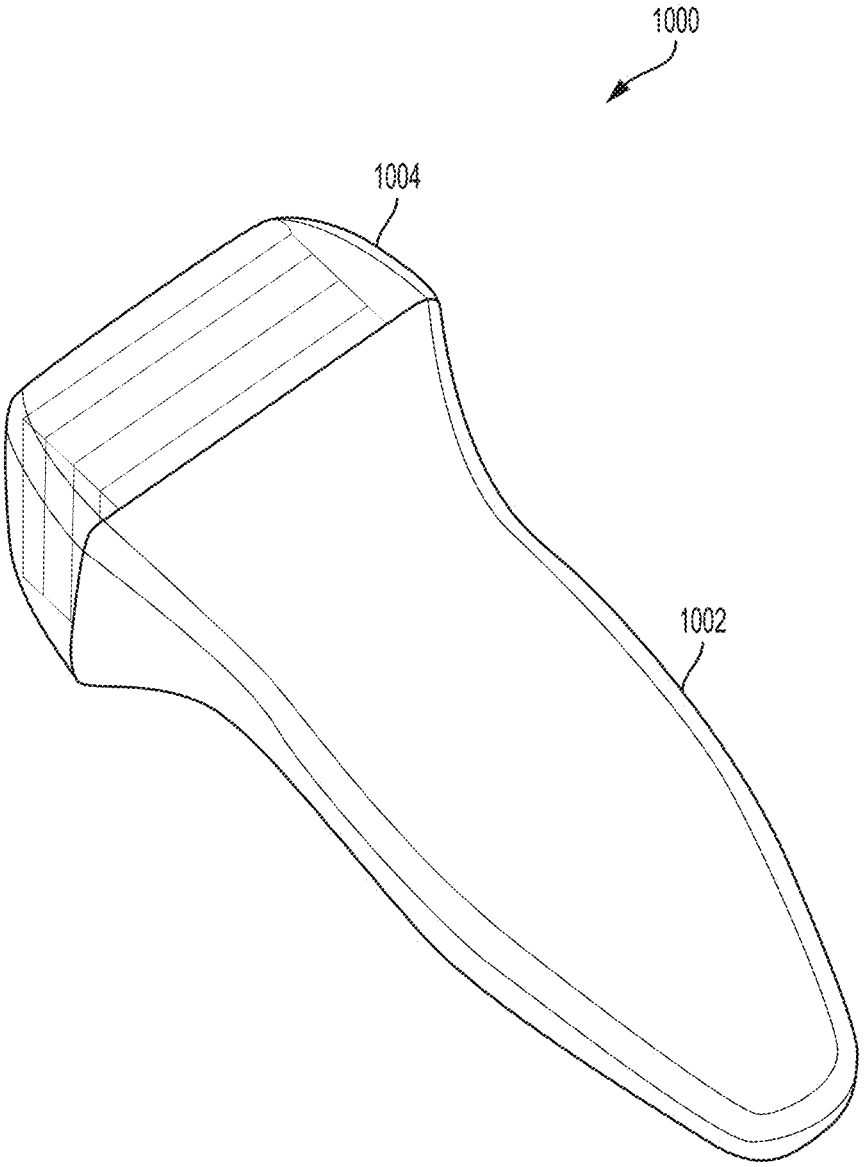
FIG. 10 shows a handheld ultrasound device in accordance with some embodiments of the technology described herein.

In some embodiments, a ultrasound device may be embodied in hand-held device 1000 shown in FIG. 10, which may considered an ultrasound probe. Hand-held device 1000 comprises a handle 1002 coupled to a probe head 1004. The probe head 1004 may comprise one or more ultrasound chips that may be configured to transmit and/or receive acoustic signals. In some embodiments, the hand-held device 1000 may be configured to transmit data collected by the device 1000 wirelessly to one or more external device for further processing. In other embodiments, hand-held device 1000 may be configured transmit data collected by the device 1000 to one or more external devices using one or more wired connections, as aspects of the technology described herein are not limited in this respect.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed.

The terms "approximately" and "about" may be used to mean within ±20% of a target value in some embodiments, within ±10% of a target value in some embodiments, within ±5% of a target value in some embodiments, and yet within ±2% of a target value in some embodiments. The terms "approximately" and "about" may include the target value.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having described above several aspects of at least one embodiment, it is to be appreciated various alterations, modifications, and improvements will readily occur to those skilled in the art. Such alterations, modifications, and improvements are intended to be object of this disclosure. Accordingly, the foregoing description and drawings are by way of example only.

What is claimed is:

1. An ultrasound device, comprising:

a differential capacitive micromachined ultrasonic transducer (CMUT) element operable in each of a plurality of modes including:

a differential receive mode, a differential transmit mode, a single-ended receive mode, and a single-ended transmit mode; and an integrated circuit, coupled to the differential CMUT element, that:

selects a mode from the plurality of modes; and operates the differential CMUT element in the selected mode.

2. The ultrasound device of claim 1, wherein the integrated circuit is configured to operate the differential CMUT element in the differential receive mode and the differential transmit mode.

3. The ultrasound device of claim 1, wherein the differential CMUT element is integrated into an ultrasonic transducer array, and the integrated circuit and the ultrasonic transducer array are disposed on a single semiconductor die.

4. The ultrasound device of claim 1, wherein the differential CMUT element comprises:

a first CMUT that is configured to be biased with a first bias voltage; and a second CMUT that is configured to be biased with a second bias voltage.

5. The ultrasound device of claim 4, wherein when operating the differential CMUT element in the differential transmit mode, the integrated circuit:

causes the first bias voltage and the second bias voltage to have opposite polarities; and drives the first CMUT and the second CMUT with pulse signals having opposite polarities.

6. The ultrasound device of claim 4, wherein the ultrasound device further comprises one or more receive circuits, and when operating the differential CMUT element in the differential receive mode, the integrated circuit:

causes the first bias voltage and the second bias voltage to have opposite polarities; and couples the differential CMUT element to the one or more receive circuits.

7. The ultrasound device of claim 4, wherein when operating the differential CMUT element in the single-ended transmit mode, the integrated circuit:

causes the first bias voltage and the second bias voltage to have a same polarity; and drives the first CMUT and the second CMUT with pulse signals having a same polarity.

8. The ultrasound device of claim 4, wherein the ultrasound device further comprises one or more receive circuits, and when operating the differential CMUT element in the single-ended receive mode, the integrated circuit:

causes the first bias voltage and the second bias voltage to have a same polarity; and couples the differential CMUT element to the one or more receive circuits.

9. The ultrasound device of claim 1, wherein the differential CMUT element comprises a first CMUT and a second CMUT, the ultrasound device further comprises a pulser circuit that drives the first CMUT with a first pulse signal and drives the second CMUT with a second pulse signal, and the first pulse signal is phase-shifted relative to the second pulse signal.

10. The ultrasound device of claim 1, wherein the differential CMUT element comprises a first CMUT and a second CMUT, and the ultrasound device further comprises:

a receive circuit comprising a first terminal and a second terminal; and a switch matrix that selectively couples the first CMUT and the second CMUT to the first terminal or the second terminal of the receive circuit.

11. An ultrasound device, comprising:

a differential micromachined ultrasonic transducer (MUT) element; and an integrated circuit coupled to the differential MUT element and configured to operate the differential MUT element in at least one of a differential receive mode and a differential transmit mode and at least one of a single-ended receive mode and a single-ended transmit mode.

12. The ultrasound device of claim 11, wherein the integrated circuit is configured to operate the differential MUT element in the differential receive mode and the differential transmit mode.

13. The ultrasound device of claim 11, wherein the differential MUT element is integrated into an ultrasonic transducer array, and the integrated circuit and the ultrasonic transducer array are disposed on a single semiconductor die.

14. The ultrasound device of claim 11, wherein the differential MUT element comprises:

a first MUT that is configured to be biased with a first bias voltage; and a second MUT that is configured to be biased with a second bias voltage.

15. The ultrasound device of claim 14, wherein when operating the differential MUT element in the differential transmit mode, the integrated circuit:

causes the first bias voltage and the second bias voltage to have opposite polarities; and drives the first MUT and the second MUT with pulse signals having opposite polarities.

16. The ultrasound device of claim 14, wherein the ultrasound device further comprises one or more receive circuits, and when operating the differential MUT element in the differential receive mode, the integrated circuit:

causes the first bias voltage and the second bias voltage to have opposite polarities; and couples the differential MUT element to the one or more receive circuits.

17. The ultrasound device of claim 14, wherein when operating the differential MUT element in the single-ended transmit mode, the integrated circuit:

causes the first bias voltage and the second bias voltage to have a same polarity; and drives the first MUT and the second MUT with pulse signals having a same polarity.

18. The ultrasound device of claim 14, wherein the ultrasound device further comprises one or more receive circuits, and when operating the differential MUT element in the single-ended receive mode, the integrated circuit:

causes the first bias voltage and the second bias voltage to have a same polarity; and couples the differential MUT element to the one or more receive circuits.

19. The ultrasound device of claim 11, wherein the differential MUT element comprises a first MUT and a second MUT, the ultrasound device further comprises a pulser circuit that drives the first MUT with a first pulse signal and drives the second MUT with a second pulse signal, and the first pulse signal is phase-shifted relative to the second pulse signal.

20. The ultrasound device of claim 11, wherein the differential MUT element comprises a first MUT and a second MUT, and the ultrasound device further comprises:

a receive circuit comprising a first terminal and a second terminal; and a switch matrix that selectively couples the first MUT and the second MUT to the first terminal or the second terminal of the receive circuit.

* * * * *